US011821304B2

(12) United States Patent
Pan et al.

(10) Patent No.: US 11,821,304 B2
(45) Date of Patent: Nov. 21, 2023

(54) DOWNHOLE TELEMETRY SYSTEM HAVING AN ELECTRO-MAGNETIC RECIEVER AND A MUD PULSER AND METHOD THEREFOR

(71) Applicant: U-Target Energy Ltd., Calgary (CA)

(72) Inventors: Xia Pan, Calgary (CA); Zhenyuan Hu, Calgary (CA); Fuchun Liu, Calgary (CA); Silviu Calin, Calgary (CA); Zhiqun Wang, Calgary (CA); Jack Wang, Calgary (CA); Michel Herzig, Calgary (CA)

(73) Assignee: U-TARGET ENERGY LTD., Calgary (CA)

( * ) Notice: Subject to any disclaimer, the term of this patent is extended or adjusted under 35 U.S.C. 154(b) by 0 days.

(21) Appl. No.: 17/161,192

(22) Filed: Jan. 28, 2021

(65) Prior Publication Data

US 2021/0254454 A1 Aug. 19, 2021

Related U.S. Application Data

(62) Division of application No. 15/967,826, filed on May 1, 2018, now Pat. No. 10,941,651.

(Continued)

(51) Int. Cl.
*E21B 47/13* (2012.01)
*E21B 47/18* (2012.01)

(Continued)

(52) U.S. Cl.
CPC ..... *E21B 47/13* (2020.05); *E21B 4/02* (2013.01); *E21B 7/067* (2013.01);

(Continued)

(58) Field of Classification Search
CPC . E21B 47/13; E21B 4/02; E21B 7/067; E21B 17/028; E21B 17/042;

(Continued)

(56) References Cited

U.S. PATENT DOCUMENTS 5,448,227 A * 9/1995 Orban ..... E21B 47/16 340/855.8
5,924,499 A * 7/1999 Birchak ..... E21B 47/20 175/50

(Continued)

FOREIGN PATENT DOCUMENTS

WO WO-2016099564 A1 * 6/2016 ..... E21B 47/024

*Primary Examiner* — James M Hewitt, II
(74) *Attorney, Agent, or Firm* — Gowling WLG (Canada) LLP

(57) ABSTRACT

A complete telemetry system and methods for downhole operations. The telemetry system includes an instrumented near-bit sub located below the Mud Motor and connected to the drill bit as well as a conventional MWD tool located above the mud motor. Parameters such as inclination of the borehole, the natural gamma ray of the formations, the electrical resistivity of the formations, and a range of mechanical drilling performance parameters are measured. Electromagnetic telemetry signals representing these measurements are transmitted uphole to a receiver associated with the conventional MWD tool located above the motor, and transmitted by this tool to the surface via mud pulse signals. The system is particularly useful for accurate control over the drilling of extended reach and horizontally drilled wells.

11 Claims, 13 Drawing Sheets

Related U.S. Application Data

(60) Provisional application No. 62/492,707, filed on May 1, 2017.

(51) Int. Cl.

| | |
|---|---|
| ***E21B 7/06*** | (2006.01) |
| ***E21B 17/02*** | (2006.01) |
| ***E21B 47/0228*** | (2012.01) |
| ***E21B 4/02*** | (2006.01) |
| ***E21B 41/00*** | (2006.01) |
| ***E21B 17/042*** | (2006.01) |
| ***E21B 49/00*** | (2006.01) |
| ***E21B 47/017*** | (2012.01) |

(52) U.S. Cl.
CPC ..... *E21B 17/0285* (2020.05); *E21B 17/042* (2013.01); *E21B 41/0085* (2013.01); *E21B 47/017* (2020.05); *E21B 47/0228* (2020.05); *E21B 47/18* (2013.01); *E21B 49/00* (2013.01)

(58) Field of Classification Search
CPC ..... E21B 41/0085; E21B 47/017; E21B 47/0228; E21B 47/18; E21B 49/00; H02K 7/1823
See application file for complete search history.

(56) References Cited

U.S. PATENT DOCUMENTS

| | | | | |
|---|---|---|---|---|
| 2008/0024319 | A1* | 1/2008 | Close | G01V 11/00 340/854.3 |
| 2014/0240141 | A1* | 8/2014 | Logan | E21B 47/18 340/854.6 |
| 2016/0003035 | A1* | 1/2016 | Logan | E21B 7/04 340/854.6 |
| 2018/0094490 | A1* | 4/2018 | Lines | E21B 7/067 |

* cited by examiner

DOWNHOLE TELEMETRY SYSTEM HAVING AN ELECTRO-MAGNETIC RECIEVER AND A MUD PULSER AND METHOD THEREFOR

CROSS-REFERENCE TO RELATED APPLICATIONS

This application is a divisional application of U.S. patent application Ser. No. 15/967,826 filed May 1, 2018, now U.S. Pat. No. 10,941,651, which claims the benefit of U.S. Provisional Patent Application Ser. No. 62/492,707, filed May 1, 2017, the content of which is incorporated herein by reference in its entirety.

FIELD OF THE DISCLOSURE

The present disclosure relates generally to a downhole telemetry system, apparatus and method.

BACKGROUND

Drilling, such as for oil & gas exploration, mining exploration, or utility river crossings often utilizes communication from subsurface sensors to the surface. Usually these sensors are located at a distance uphole from the drill bit and may measure geological parameters, positional information, and/or drilling environment conditions. This information is then used to evaluate the formation, steer the wellbore, and monitor the drilling environment for optimum drilling performance.

For example, measuring-while-drilling (MWD) systems are generally known to use downhole measurement tools to measure various useful parameters and characteristics such as the inclination and azimuth of the borehole, formation resistivity, the natural gamma-ray emissions from the formations, and/or the like. Such measurement data is sent to the surface in real-time by using a mud-pulse telemetry or an electro-magnetic (EM) telemetry.

The mud-pulse telemetry device controls a hydraulic valve which interrupts the mud flow and encodes the above-mentioned data into pressure pulses inside the drill-string. The pulses travel uphole through the mud column to the surface and are detected by the surface-dedicated equipment which then decode the detected pulses to obtain the data encoded therein. In this way, the mud-pulse telemetry device allows the transmission of the above-mentioned measurements to be observed and interpreted accurately in real time at the surface.

The EM telemetry uses the drill-string (that is, the collection of drill pipes and drill collars which connect the drill bit to the drilling rig) as an antenna to transmit relatively low frequency (for example about 10 Hz) alternating electrical signals through the earth to be detected by sensitive receivers at the surface. In order to create an antenna, the drill-string is electrically insulated at a location by a device of high-resistance, known in the art as a gap sub, for creating an electrically insulating gap along the otherwise electrically conductive steel of the drill-string.

Usually, a telemetry probe is located within the drill-string bottom-hole assembly (BHA) adjacent the gap sub. The telemetry probe contains a power source, one or more sensors, and necessary electronics for driving the telemetry. The telemetry probe has electrical connections on either side of the gap sub and effects transmission by applying alternating electrical current to these connections. The electrical current then flows through the low-resistance earth formation rather than the high-resistance gap sub. Some of the electrical current flowing through the earth formation is detectable at the surface using sensitive receivers and advanced signal processing techniques.

In order to withstand harsh drilling environments, the telemetry probes are made of high-strength metals which are inherently conductive. In order that the telemetry probes themselves do not provide electrically conductive paths for the transmission electrical current, the telemetry probes also contain electrically insulating gaps, generally referred to in the art as gap joints.

In drilling a directional well, it is common practice to employ a downhole drilling motor having a bent housing that provides a small-bend angle in the lower portion of the drill-string. Such a drilling motor with a bent housing is usually referred to as a "steerable system".

If the drill-string slides downhole without rotation (sliding mode) while the drilling motor rotates the drill bit to deepen the borehole, the inclination and/or the azimuth of the borehole will gradually change from one value to another on account of the plane defined by the bend angle. Depending on the "tool face" angle (that is, the compass direction in which the drill bit is facing as viewed from above), the borehole can be made to curve at a given azimuth or inclination.

If the drill-string is rotated and the rotation of the drill-string is superimposed over that of the output shaft of the drilling motor (rotating mode), the bent housing will simply orbit around the axis of the borehole so that the drill bit will generally drill straight ahead thereby maintaining the previously established inclination and azimuth.

Thus, various combinations of sliding and rotating drilling procedures can be used to control the borehole trajectory in a manner such that the targeted formation is eventually reached. Stabilizers, a bent sub, and a "kick-pad" can also be used to control the angle build-up rate in the sliding-mode drilling, or to ensure the stability of the bore-hole trajectory in the rotating-mode drilling.

In MWD systems, the preferred data measurement location is the location of the drill bit. However, when the prior-art MWD system is used in combination with a drilling mud motor, a plurality of components such as a non-magnetic spacer collar and other components are typically connected between the downhole measurement tool and the drilling mud motor. Consequently, the downhole measurement tool is located at a substantial distance uphole from the drilling mud motor and the drill bit (such as 40 to 200 feet uphole to the drill bit). Therefore, the actual data measurement location is biased from the preferred data measurement location by a substantial distance, for example biased by 40 to 200 feet uphole from the drill bit.

Such a biased data measurement location may cause significant measurement inaccuracy and/or delay, and may lead to errors in the drilling process. At least in the drilling of some types of directional wells, it is desirable to obtain data measurements closer to the drill bit.

For example, in cases where a plurality of "long-reach" wellbores are being drilled from a single offshore platform, each wellbore is first drilled substantially vertically and then the drilling direction is turned toward a target location via a curved path. After directional turning, the wellbore is drilled along a long, straight path tangential to the curved path until it reaches the vicinity of the target location at which the borehole is curved downwardly and then straightened to cross the formation in either a substantially vertical direction or at a small angle with respect to a vertical direction. In such directional wells, the bottom section of the borehole may be horizontally displaced from the top thereof by hundreds or even thousands of feet. The drilling of the two curved segments and the extended-reach inclined segment must be carefully monitored and controlled to ensure that the borehole enters the formation at the planned location. Therefore, it is always beneficial to obtain near-bit measurements at unbiased or less-biased locations near or close to the drill bit for improved measurement accuracy, for prompt monitoring of various characteristics or properties of the drilled formations, and/or for maintaining correct wellbore trajectory.

However, with the prior-art MWD systems located at a substantial distance uphole from the drilling mud motor and the drill bit, measurements are obtained at a biased measurement location. Therefore, the drill-string may often have to back up to correct the drilling trajectory and a cement plug may be needed to close the incorrectly drilled spots.

It has been recognized that horizontal well completions can significantly increase hydrocarbon production, particularly in relatively thin formations. In horizontal well completions, it is important to extend a downhole portion of a borehole within a target formation (instead of vertically extending therethrough) and would not cross the boundary thereof to ensure proper drainage of the formation. Moreover, the borehole is required to extend along a path that optimizes the production of oil rather than water (which is typically found in the lower region of the formation) or gas (which is typically found near the top thereof).

Therefore in horizontal well completions, the drilling process needs to be accurately controlled to maintain proper trajectory of the borehole. Drilling of the borehole also needs to be carefully conducted to ensure that the borehole does not oscillate or undulate away from a generally horizontal path along the center of the formation for avoiding completion problems that may otherwise occur at later stages. Such undulation may be a result of over-corrections caused by the measurements of directional parameters at a biased location.

In addition to the above-described benefits of obtaining near-bit measurements such as the inclination of the borehole for accurate control of the borehole trajectory, it is also beneficial to obtain near-bit measurements of some characteristics or properties of the earth formations through which the borehole passes, and in particular, the properties that may be used for trajectory control. For example, a layer of shale with known characteristics (such as known from logs of previously drilled wells) and at known location (such as at a known distance above the target formation) may be used as a "marker" formation for facilitating the maintenance of the borehole trajectory during drilling, for example where to curve the borehole to ensure the borehole to extend within the targeted formation. A marker shale may be detected by its relatively high level of natural radioactivity. A marker sandstone formation having a high salt-water saturation may be detected by its relatively low electrical resistivity.

Once a borehole has been curved and extends generally horizontally within a target formation, the measurements of the marker formation may be used to determine whether the borehole is drilled too high or too low in the formation. For example, a high gamma-ray measurement may indicate that the hole is approaching the top of the formation where a shale lies as an overburden, and a low resistivity reading may indicate that the borehole is near the bottom of the formation where the pore spaces are typically saturated with water.

Therefore, it is advantageous to locate a downhole measurement tool, also known as Near-Bit, near or close to the drill bit in a drilling-string for obtaining accurate measurements with reduced delays for accurate drilling control.

SUMMARY

The embodiments of this disclosure generally relate to a downhole apparatus. The downhole apparatus comprises an electrically conductive pin comprising a first cylindrical body, at least a first coupling section extending from the cylindrical body to a first distal end of the pin, and a longitudinal bore extending therethrough, the first coupling section comprising a first profile on an outer surface thereof; an electrically conductive box comprising a second cylindrical body, at least a second coupling section extending from the second cylindrical body to a second distal end of the box, and a longitudinal bore extending therethrough, the second coupling section comprising a second profile on an inner surface thereof and receiving therein the first coupling section with a clearance gap therebetween; and a plurality of electrically insulating locking rollers; wherein the first profile comprises a plurality of first recesses circumferentially distributed thereon, each recess extending radially inwardly and longitudinally towards the center of the pin thereby forming a surface facing radially outwardly and longitudinally towards the center of the pin, each first recess fully and movably receivable one of the plurality of locking rollers therein; wherein the second profile comprises a plurality of second recesses circumferentially distributed thereon at locations matching the locations of the first recesses thereby forming a plurality of combined locking chamber, each second recess configured for partially receiving one of the plurality of locking rollers therein; wherein the clearance gap is filled with an electrically insulating gap-filling material in solid form thereby forming an electrically insulating layer coupling the first and second coupling sections; and wherein the electrically insulating gap-filling material secures the plurality of electrically insulating locking rollers in the combined locking chambers radially between the pin and the box.

In some embodiments, each roller is made of an electrically insulating material with a high-shear strength.

In some embodiments, each roller is made of ceramic.

In some embodiments, each of the first and second profiles further comprises a plurality of longitudinally extending grooves circumferentially distributed on the respective surface, each neighboring pair of the longitudinally extending grooves of the profile form a longitudinally extending ridge; the longitudinally extending ridges of the first profile are receivable in the longitudinally extending grooves of the second profile, and the longitudinally extending ridges of the second profile are receivable in the longitudinally extending grooves of the first profile; and each of the first and second profiles further comprises a plurality of circumferentially extending notches longitudinally distributed on the respective surface forming a plurality of circles in parallel and perpendicular to a longitudinal axis of the downhole apparatus.

In some embodiments, the first profile comprises a first tapering portion extending towards the first distal end; and the second profile comprises a second tapering portion extending towards a proximal end of the second profile, the second tapering portion substantively matching the first tapering portion.

In some embodiments, the first profile further comprises a first proximal cylindrical portion extending from the first cylindrical body to the first tapering portion, and a first distal cylindrical portion extending from the first tapering portion to the first distal end; the second profile comprises a second distal cylindrical portion extending from the second distal end to the second tapering portion, and a second proximal cylindrical portion extending from the second tapering portion to the proximal end of the second profile; and the second distal cylindrical portion and the second proximal cylindrical portion substantively match the first proximal cylindrical portion and the first distal cylindrical portion, respectively.

In some embodiments, the plurality of first recesses are located on the tapering portion of the first profile, and the plurality of second recesses are located on the tapering portion of the second profile.

In some embodiments, the electrically insulating gap-filling material is at least one of a thermosetting resin, a high-temperature-bearing plastic, a thermosetting resin with ceramic micro-particles, and a fiberglass epoxy.

In some embodiments, the thermosetting resin is a two-part epoxy.

In some embodiments, the downhole apparatus further comprises an electrically insulating spacing assembly longitudinally between the distal end of the first couple section and a proximal end of the second coupling section for longitudinally separating the pin and the box from direct contact.

In some embodiments, the electrically insulating spacing assembly comprises at least a first electrically insulating ring between the distal end of the first couple section and the proximal end of the second coupling section for separating the pin and the box from direct contact.

In some embodiments, the electrically insulating spacing assembly comprises at least a second electrically insulating ring extending into the bore of the pin against a first shoulder therein and extending into the bore of the box against a second shoulder therein for separating the pin and the box from direct contact and for concentricity of the pin and the box.

In some embodiments, the electrically insulating spacing assembly is an electrically insulating ring comprising a first portion between the distal end of the first couple section and the proximal end of the second coupling section for separating the pin and the box from direct contact and for concentricity of the pin and the box, and a second portion extending into the bore of the pin against a first shoulder therein and extending into the bore of the box against a second shoulder therein for separating the pin and the box from direct contact and for concentricity of the pin and the box.

In some embodiments, the electrically insulating spacing assembly is a ceramic spacing assembly.

In some embodiments, the downhole apparatus further comprises an electrically insulating seal sleeve between the first cylindrical body of the pin and the second coupling section of the box.

In some embodiments, the electrically insulating seal sleeve comprises a first portion between the first cylindrical body of the pin and the second coupling section of the box, and a second portion radially sandwiched between the first and second profiles.

In some embodiments, at least one of the first and second cylindrical bodies comprises one or more chambers for receiving therein one or more data measurement and transmission components, and one or more covers for sealably closing the one or more chambers.

In some embodiments, the downhole apparatus further comprises one or more injection ports in fluid communication with the clearance gap for injecting the gap-filling material in a fluid form.

In some embodiments, the downhole apparatus further comprises an elastomer sleeve receiving therein at least a portion of the pin and at least a portion of the box.

In some embodiments, the downhole apparatus further comprises a protection sleeve receiving therein the elastomer sleeve.

In some embodiments, the protection sleeve is a ceramic sleeve.

In some embodiments, each of the longitudinally extending grooves comprises a cross-section of a half-circular shape, a half-elliptical shape, a rectangular shape, or a rectangular shape with two round corners.

In some embodiments, either one of the pin and the box further comprises a plurality of spring-loaded electrical-contact pads pivotably mounted thereon for contacting subsurface earth.

In some embodiments, each of the plurality of spring-loaded electrical-contact pads comprises a profile curved towards the radial center of the pin or the box that the pad is mounted thereon, and is coupled to a spring for being biased radially outwardly.

In some embodiments, the longitudinally extending ridges of the first profile are received in the longitudinally extending grooves of the second profile without direct contact, and the longitudinally extending ridges of the second profile are received in the longitudinally extending grooves of the first profile without direct contact.

In some embodiments, on the first and second profiles, the plurality of circumferentially extending notches thereof form a plurality of circumferentially extending teeth, and each of the longitudinally extending grooves thereof comprises a subset of the plurality of circumferentially extending notches and the plurality of circumferentially extending teeth therebetween; and each of the plurality of longitudinally extending ridges of the first profile is circumferentially overlapped with a corresponding one of the plurality of longitudinally extending ridges of the second profiles such that the circumferentially extending teeth thereof are received in the circumferentially extending notches thereof without direct contact.

In some embodiments, the downhole apparatus further comprises a plurality of electrically insulating inserts; wherein each of the plurality of longitudinally extending grooves of the first profile is circumferentially overlapped with a corresponding one of the plurality of longitudinally extending grooves of the second profiles, and is configured for receiving therein at least one of the plurality of inserts.

In some embodiments, each of the plurality of electrically insulating inserts has a cross-sectional shape matching that of the corresponding pair of overlapped grooves of the first and second profiles; and wherein said cross-sectional shape is any one of a circle, a rectangle, an ellipse, or a round-corner rectangle.

In some embodiments, the plurality of electrically insulating inserts have a same cross-sectional shape.

In some embodiments, the plurality of electrically insulating inserts have different cross-sectional shapes.

According to one aspect of this disclosure, there is provided a bottom-hole assembly for use in a subterranean area under a surface, the bottom-hole assembly comprises a first sub directly or indirectly coupled to a drill bit, the first sub comprising at least one or more sensors for collecting sensor data and an Electro-Magnetic (EM) transmitter for transmitting the sensor data via EM signals; a mud motor directly or indirectly coupled to the first sub; and a telemetry sub assembly directly or indirectly coupled to the mud motor; wherein the telemetry sub assembly comprises at least: an EM receiver for receiving the EM signals transmitted from the EM transmitter of the first sub; and a mud pulser for generating mud pulses based on the received EM signals for transmitting the sensor data to the surface.

According to one aspect of this disclosure, there is provided a downhole apparatus comprising an electrically conductive pin comprising a first cylindrical body, at least a first coupling section extending from the cylindrical body to a first distal end of the pin, and a longitudinal bore extending therethrough, the first coupling section comprising a first profile on an outer surface thereof; and an electrically conductive box comprising a second cylindrical body, at least a second coupling section extending from the second cylindrical body to a second distal end of the box, and a longitudinal bore extending therethrough, the second coupling section comprising a second profile on an inner surface thereof and receiving therein the first coupling section with a clearance gap therebetween; wherein each of the first and second profiles comprises a plurality of longitudinally extending grooves circumferentially distributed on the respective surface, each neighboring pair of the longitudinally extending grooves of the profile form a longitudinally extending ridge; wherein the longitudinally extending ridges of the first profile are receivable in the longitudinally extending grooves of the second profile, and the longitudinally extending ridges of the second profile are receivable in the longitudinally extending grooves of the first profile; wherein each of the first and second profiles further comprises a plurality of circumferentially extending notches longitudinally distributed on the respective surface forming a plurality of circles in parallel and perpendicular to a longitudinal axis of the downhole apparatus; and wherein the clearance gap is filled with an electrically insulating gap-filling material in solid form thereby forming an electrically insulating layer coupling the first and second coupling sections.

According to one aspect of this disclosure, there is provided a mud-activated power generator comprising: a housing having a chamber therein in fluid communication with two longitudinally opposite ports thereof, a first sidewall of the housing comprising therein one or more first pockets circumferentially about the chamber, each first pocket receiving therein one or more coils; and a rotor rotatably received in the chamber; wherein the rotor comprises a longitudinal bore in fluid communication with the chamber; a sidewall about the longitudinal bore and comprising one or more second pockets receiving therein one or more magnets; and one or more blades extending from an inner surface of the rotor radially inwardly and longitudinally at an acute angle with respect to an axis of the rotor.

In some embodiments, the housing comprises a downhole-facing circumferential shoulder on an inner surface of the sidewall defining an uphole end of the chamber.

In some embodiments, the housing comprises a ring removably mounted to the inner surface of the sidewall defining a downhole end of the chamber.

In some embodiments, the ring is removably mounted to the inner surface of the sidewall by threads.

In some embodiments, the ring is made of a first hard material.

In some embodiments, the first hard material is tungsten carbide or ceramic.

In some embodiments, the rotor has a length shorter than that of the chamber.

In some embodiments, the rotor and ring comprise a plurality of buttons on their engaging ends for acting as a friction gear.

In some embodiments, the plurality of buttons are made of a second hard material.

In some embodiments, the second hard material is tungsten carbide or ceramic.

DETAILED DESCRIPTION

System Structure

Figure 1:
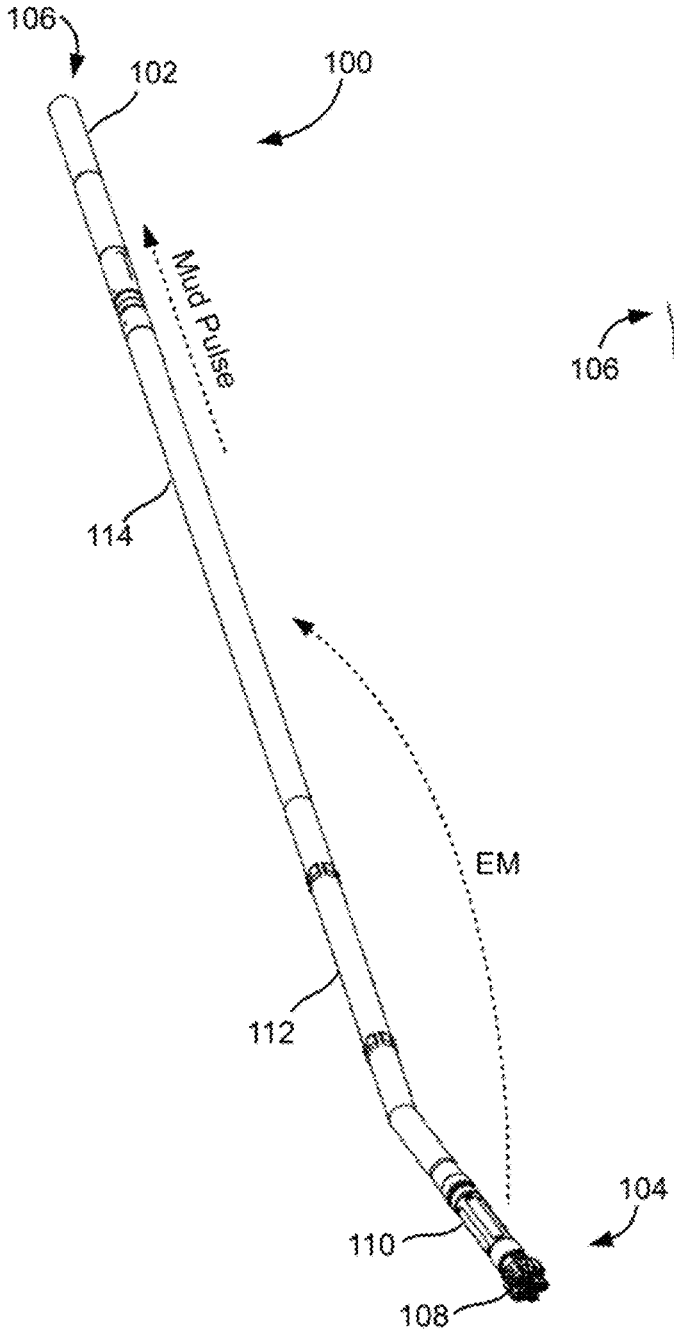
FIG. 1 is a perspective view of a bottom-hole assembly (BHA) coupled to a drilling string according to some embodiments of this disclosure.
Figure 2:
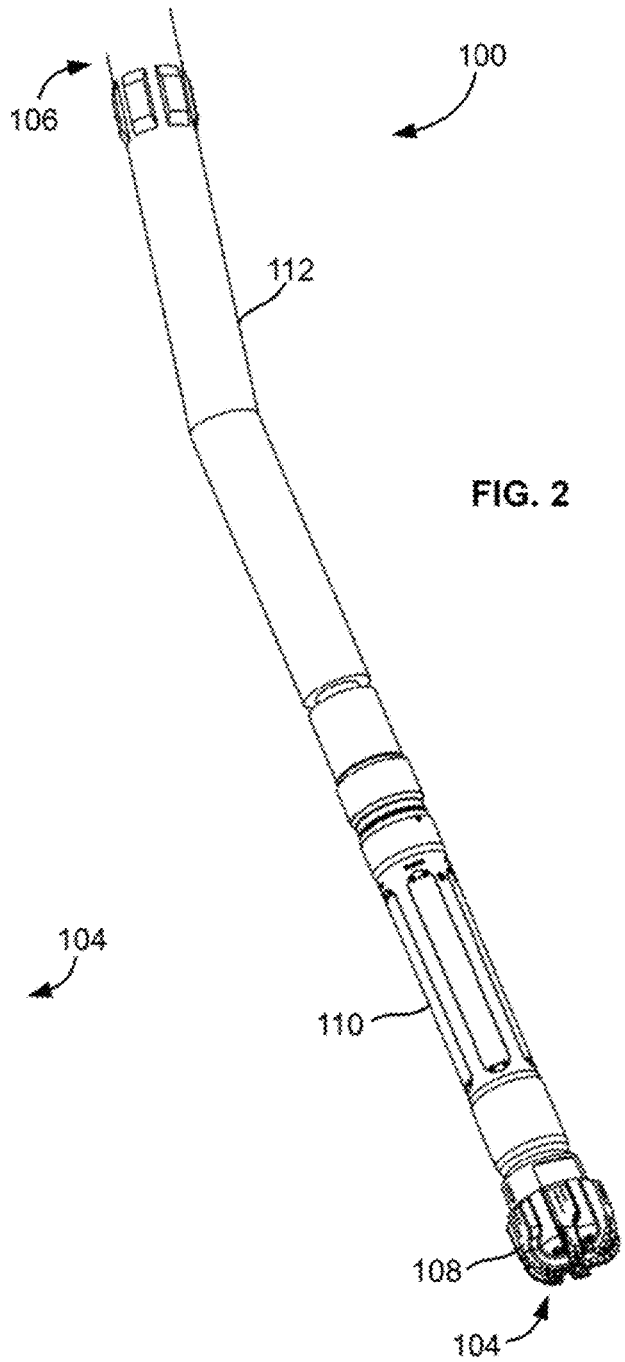
FIG. 2 is an enlarged perspective view of the BHA shown in FIG. 1.

Turning now to FIGS. 1 and 2, a downhole telemetry system is shown and is generally identified using reference numeral 100. In these embodiments, the downhole telemetry system 100 is a Bottom-Hole Assembly (BHA) coupled to a drilling string 102. From a downhole side 104 to an uphole side 106, the BHA 100 comprises a drill bit 108, a near-bit sub 110, a drilling motor 112 such as a mud motor, and a telemetry assembly 114, coupled to each other in series. As those skilled in the art will appreciate, the housing of the drilling motor 112 may be made with, or be adjustable to have a small bend angle in the lower portion thereof for directional drilling, that is, drilling a curved borehole in the sliding mode (drilling string 102 not rotating) or drilling substantially straight borehole in the rotation mode (drilling string 102 rotating).

The near-bit sub 110 is a measuring-while-drilling (MWD) tool. As will be described in more detail later, the near-bit sub 110 comprises a sub body having a longitudinal central bore extending therethrough for allowing fluid communication between the mud motor 112 and the drill bit 108, and one or more sensors/transducers and other suitable components received in the sub body for data sensing and transmission.

Figure 3:
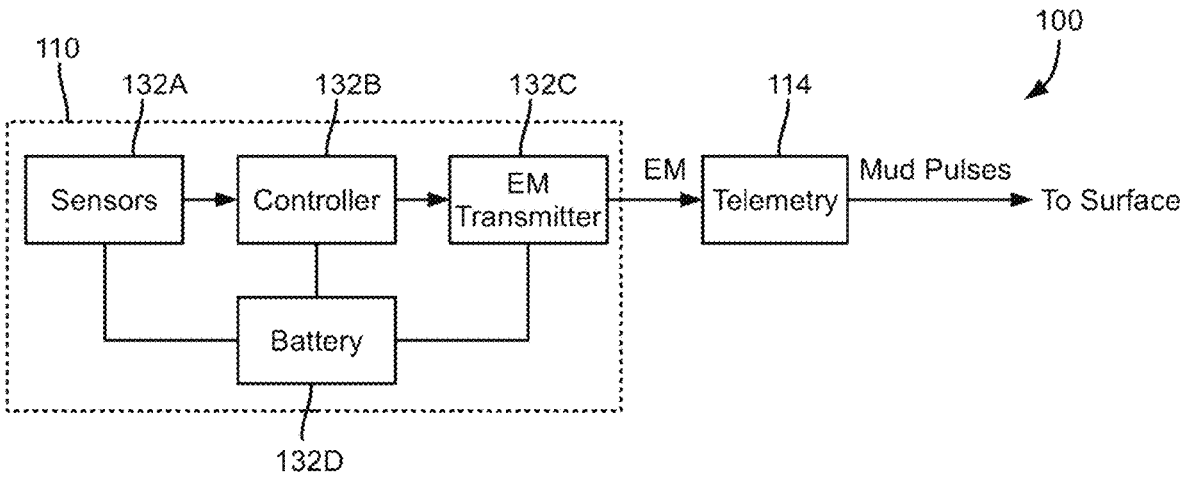
FIG. 3 is a functional diagram of the BHA shown in FIG. 1.

FIG. 3 is a functional diagram of the BHA 100. As shown, the near-bit sub 110 comprises a plurality of data measurement and transmission components 132 including one or more sensors/transducers 132A, a controller 132B, and an electromagnetic (EM) signal transmitter 132C, all powered by one or more batteries 132D such as one or more lithium or alkaline batteries. The data measurement and transmission components 132 may also comprise other components as required.

The sensors 132A may measure a variety of downhole parameters while drilling. For example, some of the sensors 132A may be used to obtain azimuthal measurement and wellbore parameters such as borehole trajectory parameters (for example, the inclination of the borehole) and geological formation characteristics useful for proper diagnosis of a change in drilling direction and maintaining accurate control over the direction of the wellbore for penetrating a target formation and then extending therewithin.

Some of the sensors 132A may measure formation parameters such as the natural gamma ray emission of the formation, the electrical resistivity of the formation, and/or the like.

Some of the sensors 132A may measure mechanical drilling performance parameters such as the rotation speed (in terms of revolutions per minute (RPM)) of the shaft of the mud motor 112 for continuously monitoring the drilling process and parameters thereof such as weight-on-bit, motor torque, and/or the like.

Some of the sensors 132A may measure parameters such as vibration levels that may adversely affect the measurement of other variables such as inclination, and may cause resonant conditions that reduce the useful life of tool string components. Such measurement can also be used in combination with surface standpipe pressures to analyze reasons for changes in the rates at which the bit penetrated the formation.

In implementation and various use cases, one may combine the sensors 132A for measuring one or more of the above-described parameters and/or any other parameters as needed.

Compared to traditional downhole measurement tool typically located at a large distance (such as 40 to 200 feet) uphole to the drill bit 108, the near-bit sub 110 is at a substantively short distance (such as about 2 feet) uphole to the drill bit 108. By arranging the near-bit sub 110 in proximity with the drill bit 108, sensors 132A in the near-bit sub 110 may obtain measurement data with improved measurement accuracy and reduced measurement delay. The obtained measurement data may be used for accurate control of the directional drilling of a wellbore.

Referring again to FIG. 3 and also referring to FIG. 1, the controller 132B collects sensor data from the sensors 132A, processes (such as encodes and/or modulates) collected sensor data into a format suitable for EM transmission, and uses the EM signal transmitter 132C to transmit the processed data to the telemetry assembly 114 via an EM signal.

Figure 4:
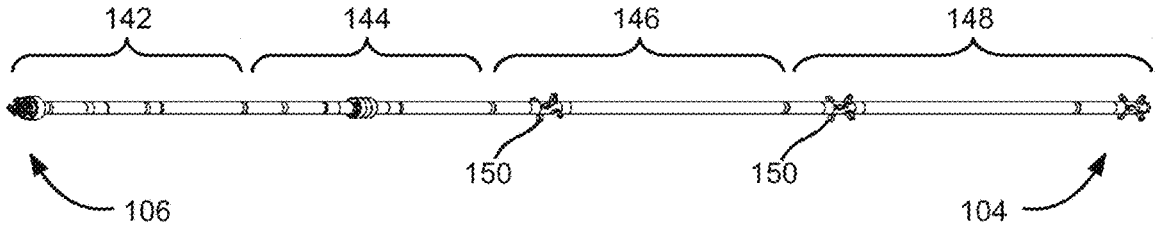
FIG. 4 is a perspective view of a telemetry assembly of the BHA shown in FIG. 1.

In these embodiments, the telemetry assembly 114 is a conventional MWD sub assembly and also acts as a relay for the near-bit sub 110 for transmitting the sensor data to the surface. FIG. 4 is a perspective view of an example of the telemetry assembly 114. As shown, the telemetry assembly 114 comprises, from the uphole side 106 to the downhole side 104, a pulser 142 for generating mud pulses, an EM receiver 144, a battery section 146, and MWD section 148. The EM receiver 144 receives the EM signal transmitted from the near-bit sub 110 which is decoded to recover the sensor data. A plurality of centralizers 150 are used for maintaining the telemetry assembly 114 at the center of the wellbore.

The MWD section 148 comprises one or more sensors for collecting measurement data which may be combined with or may be used for verification of the sensor data received from the near-bit sub 110. The combined or verified data is then encoded and used for controlling the pulser 142 to modulate the mud pulses for transmitting the data to the surface where the data is decoded substantially in real time. By using the decoded data, a drilling system at the surface may accurately control the drilling of extended reach and horizontally drilled wells.

In some embodiments, the telemetry assembly 114 may not comprise a pulser 142. Rather, the telemetry assembly 114 may comprise an EM transmitter to transmit the sensor data to the surface via an EM signal.

In some embodiments, the telemetry assembly 114 may comprise both a pulser 142 and an EM transmitter for transmitting the sensor data to the surface via both modulated mud pulses and an EM signal for achieving improved signal transmission reliability.

In above embodiments, the telemetry assembly 114 is a conventional MWD also acting as a relay for the near-bit sub 110 for transmitting the sensor data to the surface. In some alternative embodiments, the telemetry assembly 114 does not comprise a conventional MWD and only comprises a mud-pulse telemetry and/or an EM telemetry (such as the pulser 142 and/or an EM transmitter) for relaying the sensor data to the surface.

Although in above embodiments the near-bit sub 110 only comprises an EM signal transmitter for transmitting sensor data to the telemetry assembly 114, in some embodiments, the near-bit sub 110 may comprise an EM signal transceiver for transmitting and receiving EM signals to and from the telemetry assembly 114. Similarly, the telemetry assembly 114 may also comprise an EM transceiver and/or a mud pulse transceiver for transmitting and receiving EM signals to and from the surface. Then, the near-bit sub 110 may receive downlink commands from the surface via the telemetry assembly 114.

Although in above embodiments the BHA 100 uses a telemetry assembly 114 for relaying the sensor data collected by the near-bit sub 110, in some alternative embodiments, the near-bit sub 110 may encode the sensor data into EM signals and directly transmit the EM signals through the formation to the surface by using EM signals. As the battery 132D may only have limited power due to the limited space of the near-bit sub 110, a mud-activated power generator may be used with the batteries 132D for powering the electrical components of the near-bit sub 110.

In above embodiments, the near-bit sub 110 is directly coupled to the drill bit 108 and the mud motor 112. In some alternative embodiments, the BHA 100 may comprise other suitable subs between the near-bit sub 110 and the drill bit 108 and/or between the near-bit sub 110 and the drilling motor 112.

EM Data Transmission Between the Near-Bit Sub and the Telemetry Sub

In various embodiments, the sensor data may be transmitted from the near-bit sub 110 to the telemetry assembly 114 via any suitable EM-transmission ways using super-low frequency (SLF) signals and/or extremely-low frequency (ELF) signals.

In some embodiments, an EM transmission method using dual-electric dipole antenna is used for transmitting sensor data from the near-bit sub 110 to the telemetry assembly 114. In these embodiments, the near-bit sub 110 comprises a gapped mechanical connection (having two electrically-conductive metal body sections separated by an electrically insulating layer) forming a dipole antenna for transmitting the sensor data via an EM signal (described in more detail later). Correspondingly, the telemetry assembly 114 is coupled to a gap sub that also comprises a gapped mechanical connection forming a dipole antenna for receiving the EM signal transmitted from the near-bit sub bearing the sensor data.

Those skilled in the art will appreciate that, in some embodiments, the telemetry assembly 114 is also structured as a gap sub for receiving the EM signal transmitted from the near-bit sub bearing the sensor data.

Figure 15A:
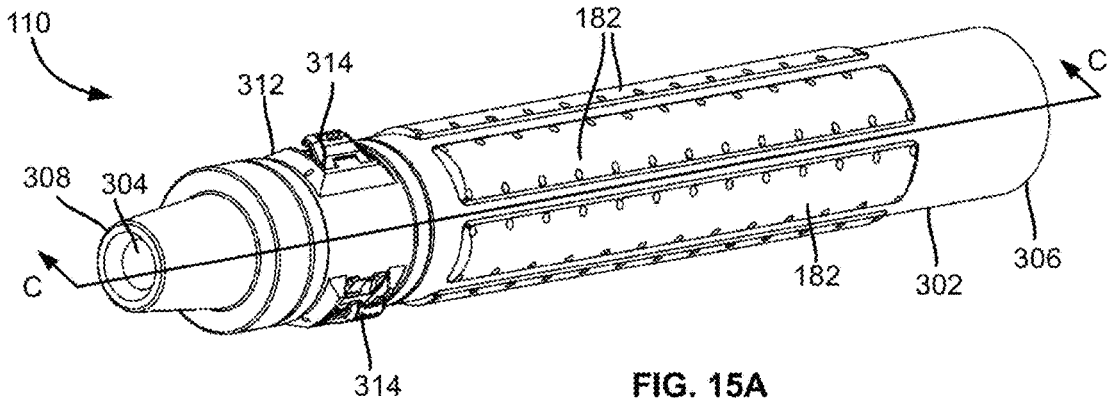
FIG. 15A is a perspective view of a near-bit sub having an electrically-insulated sleeve and spring-loaded electrical-contact pads, according to some embodiments of this disclosure.
Figure 15B:
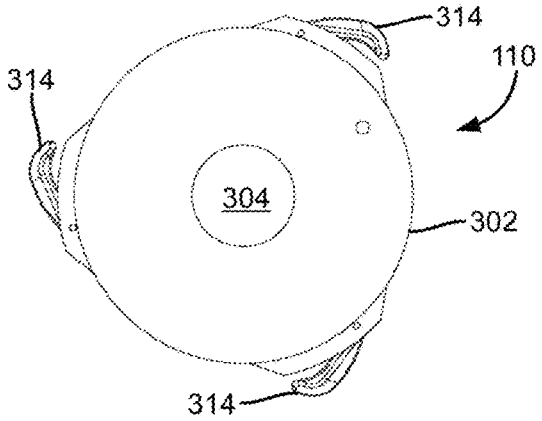
FIG. 15B is a front view of the near-bit sub shown in FIG. 15A.
Figure 15C:
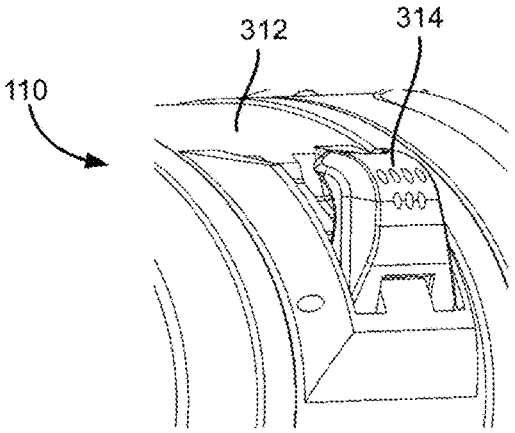
FIG. 15C is an enlarged perspective view of a portion of the near-bit sub shown in FIG. 15A, showing a spring-loaded electrical-contact pad thereof.
Figure 15D:
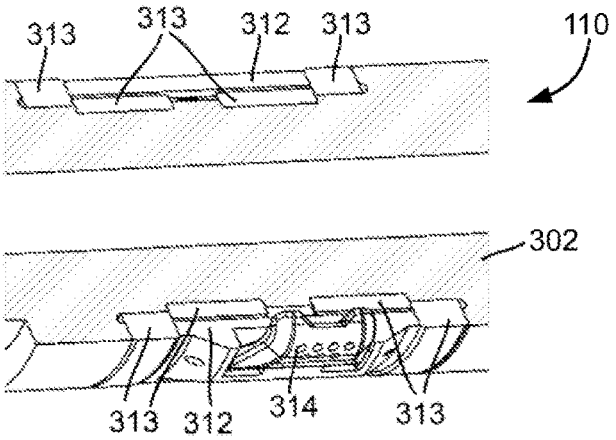
FIG. 15D is a perspective cross-sectional view of a portion of the near-bit sub shown in FIG. 15A along the cross-sectional line C-C.

In some embodiments, an EM transmission method using dual-electric dipole antenna sub with insulated ring is used for transmitting sensor data from the near-bit sub 110 to the telemetry assembly 114. In these embodiments, the near-bit sub 110 comprises a gapped ring forming a dipole antenna for transmitting the sensor data via an EM signal. Correspondingly, the telemetry assembly 114 comprises a gap sub also having a gapped ring (see FIG. 15D, described later) forming a dipole antenna for receiving the EM signal transmitted from the near-bit sub bearing the sensor data.

In some embodiments, the near-bit sub 110 may use an insulated sleeve having a plurality of (for example, three) spring-loaded contact pads for direct contact between the drill-string and the formation for data transmission via an EM signal (described later). The telemetry assembly 114 may comprise a gap sub having an electric dipole antenna for receiving the EM signal. By using the insulated sleeve, the near-bit sub 110 may be constructed as a one-piece sub with a stronger and less-expensive structure, compared to other embodiments.

In some embodiments, the near-bit sub 110 may comprise one or more loop-stick antennae for data transmission, and the telemetry assembly 114 may also comprise a gap sub having a loop-stick antenna for data receiving. The near-bit sub 110 in these embodiments may be constructed as a one-piece sub with a stronger and less-expensive structure, compared to other embodiments.

In some embodiments, the near-bit sub 110 may comprise both an electric dipole antenna and one or more loop-stick antennae for data transmission, and the telemetry assembly 114 may also comprise both an electric dipole antenna and one or more loop-stick antennae for data receiving. With this configuration, the BHA 100 in these embodiments may provide improved reliability with regard to inclination level and formation resistivity level.

Near-Bit Sub

Figure 5:
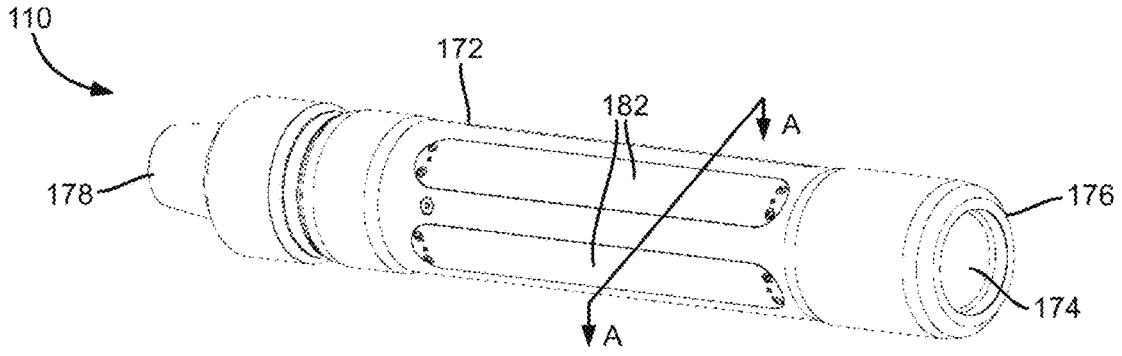
FIG. 5 is a perspective view of a near-bit sub of the BHA shown in FIG. 1, according to some embodiments of this disclosure.
Figure 6:
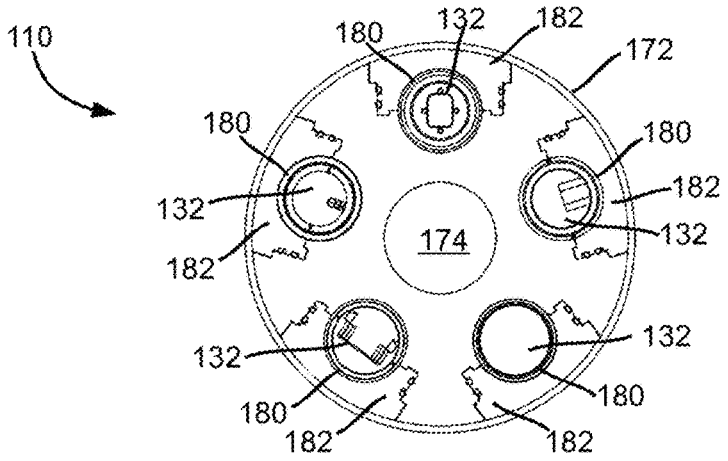
FIG. 6 is a cross-sectional view of the near-bit sub shown in FIG. 5 along the cross-sectional line A-A.

The near-bit sub 110 is located uphole of and in proximity with the drill bit 108. FIG. 5 is a perspective view of the near-bit sub 110 in some embodiments. FIG. 6 is a cross-sectional view of the near-bit sub 110 along the cross-sectional line A-A shown in FIG. 5. As shown, the near-bit sub 110 comprises a sub body 172 having a longitudinal central bore 174 extending therethrough from a downhole end 176 to an uphole end 178 thereof for fluid communication between the mud motor 112 and the drill bit 108. The sub body 172 comprises therein one or more chambers or pockets 180 circumferentially about the longitudinal central bore 174 for accommodating therein the data measurement and transmission components 132. Each chamber 180 is sealably closed by a cover 182.

In some embodiments, the one or more sensors/transducers may be located within the chambers 180 close to the downhole end 176 of the near-bit sub 110 for further improving the measurement accuracy and for further reducing measurement delay.

As described above, the data measurement and transmission components 132 comprise the one or more sensors/transducers 132A, the controller 132B, the electromagnetic (EM) signal transmitter 132C, the one or more batteries 132D, and other suitable components. For example, in one embodiment, one or more loop-stick antennae may be received in the chambers 180. In an alternative embodiment, each of the one or more loop-stick antennae may be arranged in the near-bit sub 110 has a structure circumferentially about the longitudinal central bore 174.

Figure 7:
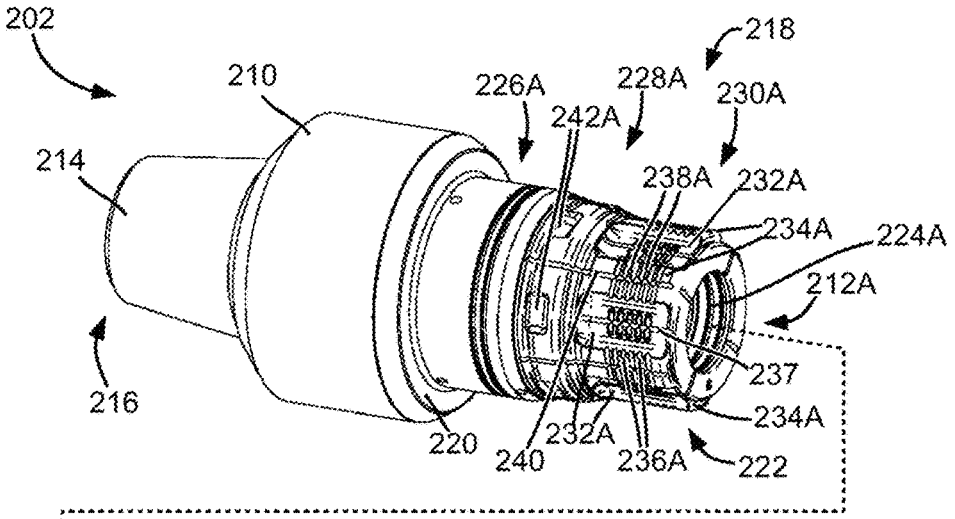
FIGS. 7 and 8 are perspective views of a pin and a box, respectively, of the near-bit sub shown in FIG. 5, according to some embodiments of this disclosure.
Figure 8:
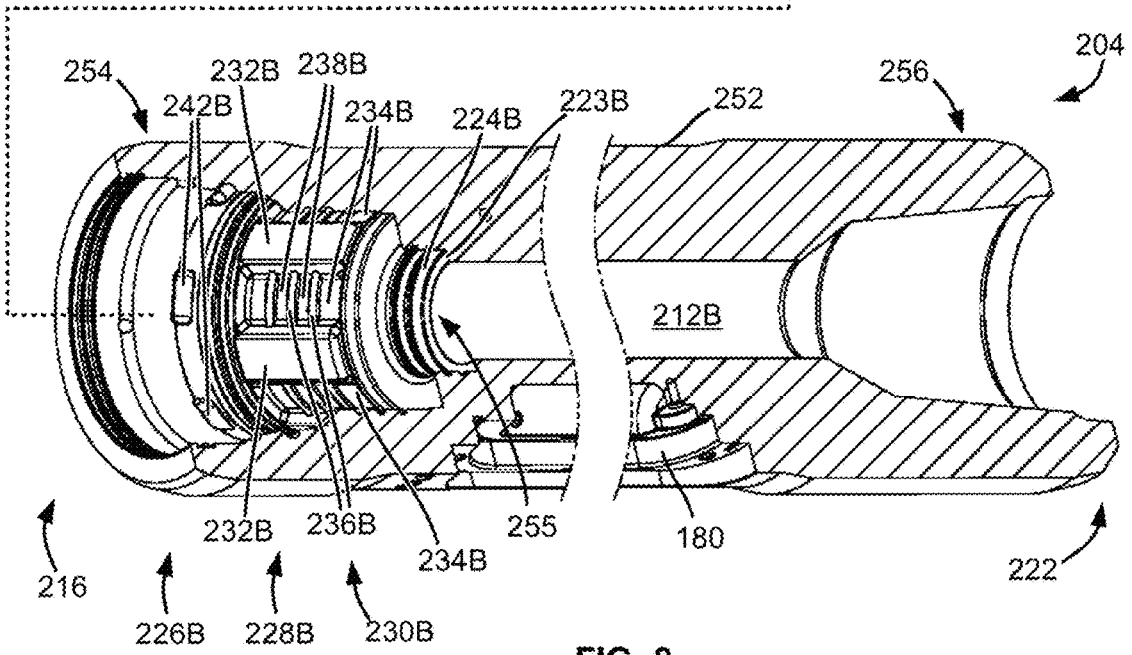

In some embodiments, the near-bit sub 110 comprises an electrically insulated gap connection. As shown in FIGS. 7 and 8, the near-bit sub 110 in these embodiments comprises two electrically conductive metal parts including a pin 202 coupled to a box 204 downhole thereto.

The pin 202 and the box 204 are electrically insulated thereby forming an electrically insulating gap therebetween. As those skilled in the art will appreciate, the pin 202 may be electrically coupled to the telemetry assembly 114 and the box 204 may be electrically coupled to the formation for acting as an antenna.

As shown in FIG. 7, the pin 202 comprises a cylindrical body 210 having a longitudinal central bore 212A extending therethrough, an uphole coupling section 214 extending from the cylindrical body 210 to an uphole end 216 of the pin 202 and having threads (not shown) on the outer surface thereof for coupling to another sub such as the mud motor 112, and a downhole coupling section 218 extending from the cylindrical body 210 to a downhole end 222 of the pin 202 (which is also a distal end of the downhole coupling section 218) for coupling to the box 204. The central bore 212A comprises an enlarged portion forming a chamber 224A (i.e., with an enlarged inner diameter) adjacent the downhole end 222 for receiving a ceramic ring (described later). The chamber 224A thus forms a downhole-facing circumferential shoulder 223A at an uphole end thereof (see FIGS. 10A, 11A and 11B).

The downhole coupling section 218 has a smaller outer diameter than that of the cylindrical body 210, thereby forming a downhole-facing circumferential shoulder 220. The downhole coupling section 218 comprises a profile on the outer surface thereof formed by a cylindrical first portion 226A extending from the cylindrical body 210 and transiting to a tapering second portion 228A which in turn transits to a cylindrical third portion 230A adjacent the downhole end 222.

Figure 9:
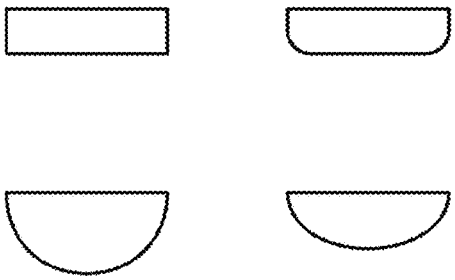
FIG. 9 show a plurality of cross-sectional shapes of a longitudinally extending groove of the pin shown in FIG. 7, according to various embodiments of this disclosure.

The third portion 230A is machined to comprise a plurality of longitudinally extending grooves 232A longitudinally extending to the downhole end 222 and circumferentially distributed on the outer surface thereof about the longitudinal central bore 212A. As shown in FIG. 9, the cross-section of each groove 232A in various embodiments may have any suitable shape that prevents interference with the box 204 during installation, such as a half-circular shape, a half-elliptical shape, a rectangular shape, a rectangular shape with two round corners, or the like.

Referring again to FIG. 7, each pair of neighboring grooves 232A form a longitudinally extending ridge 234A. The longitudinally extending ridges 234A are machined to comprise a plurality of circumferentially extending notches 236A longitudinally distributed thereon. Each pair of neighboring notches 236A thus form a circumferentially extending tooth 238A. The circumferentially extending notches 236A form a plurality of discrete circles (interrupted by the grooves 232A) in parallel with each other, and act as channels for injecting an electrically insulating gap-filling material (described later).

The third portion 230A also comprises a plurality of notches or channels 240 longitudinally extending from the second portion 228A through the longitudinally extending ridges 234A to the downhole end 222 for facilitating injection of an electrically insulating gap-filling material. The grooves 232A may also comprise a plurality of notches 237.

Unlike the conventional coupling methods that use helical threads which are at inclined angles with respect to the longitudinal axis, the discrete circles formed by the circumferentially extending notches 236A are perpendicular to the longitudinal axis of the pin 202 (also the longitudinal axis of the near-bit sub 110 after assembling). In other words, each discrete circle is in a plane perpendicular to the longitudinal axis of the pin 202.

The second portion 228A comprises a plurality of recesses or pockets 242A circumferentially distributed on the outer surface thereof and axially aligned with but at a distance from the grooves 232A.

Figure 10A:
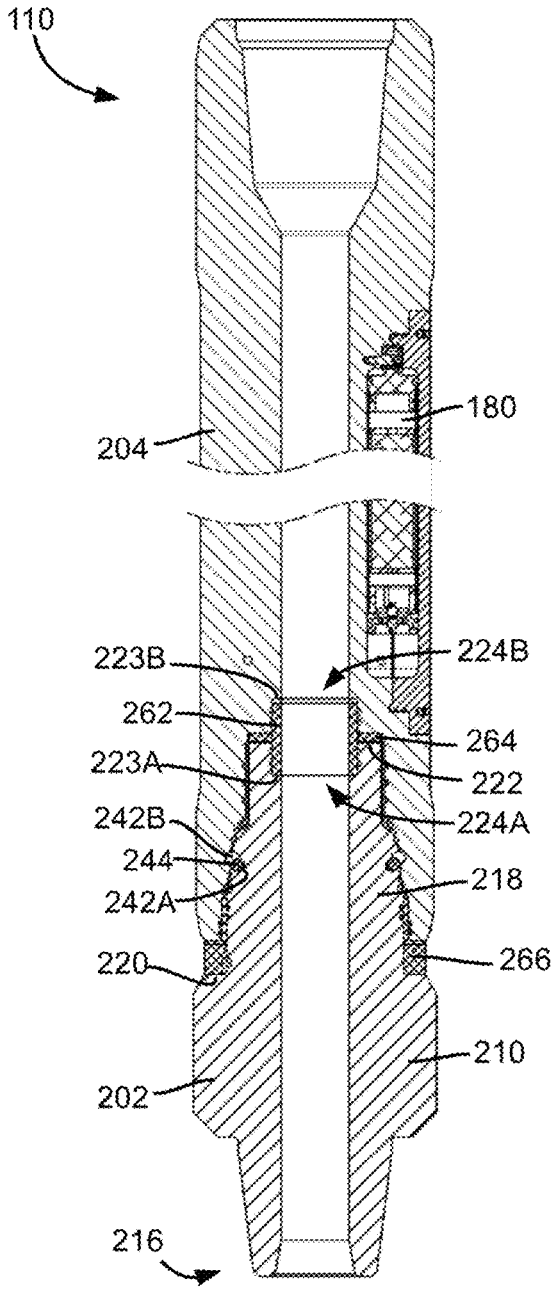
FIG. 10A is a cross-sectional view of the pin and the box shown in FIGS. 7 and 8, respectively, engaged with each other during an assembling process of the near-bit sub shown in FIG. 5, wherein a plurality of locking rollers are fully received within a plurality of pockets of the pin.

Also referring to FIG. 10A, each pocket 242A extends radially inwardly and axially towards the center of the pin 202 (i.e., axially towards the uphole end 216 or axially away from the downhole end 222), thereby forming an inclined radial extension (with respect to the longitudinal axis). In these embodiments, each pocket 242A has a size suitable for substantially fully and movably receiving therein an electrically insulating locking roller 244 such as a locking cylinder or a locking ball. The locking rollers 244 may be made of an electrically insulating material with a high-shear strength such as ceramic.

As shown in FIG. 8, the box 204 comprises a cylindrical body 252 having a longitudinal central bore 212B extending therethrough and one or more chambers 180 therein for receiving one or more data measurement and transmission components.

The cylindrical body 252 comprises an uphole coupling section 254 adjacent an uphole end (also denoted as a distal end of the uphole coupling section 254 and identified using reference numeral 216) for coupling to the pin 202, and a downhole coupling section 256 adjacent a downhole end (also identified using reference numeral 222) and comprising threads (not shown) on the inner surface thereof for coupling to another sub such as the drill bit 108. The central bore 212B comprises an enlarged portion forming a chamber 224B adjacent a proximal end 225 of the uphole coupling section 254 (i.e., the end of the uphole coupling section 254 adjacent the cylindrical body 252) for receiving a ceramic ring (described later). The chamber 224B thus forms an uphole-facing circumferential shoulder 223B (see FIGS. 10A, 11A and 11B).

On the inner surface thereof, the uphole coupling section 254 comprises a profile substantively matching that of the downhole coupling section 218 of the pin 202 such that the downhole coupling section 218 of the pin 202 may be received in the uphole coupling section 254 of the box 204 with a clearance gap therebetween. In particular, the inner surface of the uphole coupling section 254 comprises a cylindrical first portion 226B extending from the uphole end 216 and transiting to a tapering second portion 228B which in turn transits to a cylindrical third portion 230B adjacent the enlarged central bore portion 224B.

The second portion 228B comprises a plurality of recesses or pockets 242B at suitable locations for matching the pockets 242A of the pin 202 when the pin 202 and the box 204 are coupled together. For example, the pockets 242B are axially aligned with the ridges 234B (described later) and at a same distance thereto as the distance between the pocket 242A and the corresponding groove 232A.

Also referring to FIG. 11, each pocket 242B has a length and a width suitable for movably receiving therein an electrically insulating locking roller 244. However, each pocket 242B has a "shallow" radial depth only allowing the locking roller 244 be partially received therein.

The third portion 230B is machined to comprise a plurality of longitudinally extending grooves 232B circumferentially distributed on the inner surface thereof. Each groove 232B extends longitudinally from the uphole end 216 to a location at a distance to the pockets 242B. Each pair of neighboring grooves 232B form a longitudinally extending ridge 234B. The grooves 232B and ridges 234B of the box 204 are suitable for engaging the corresponding ridges 234A and grooves 232A of the pin 202 without direct contact.

The longitudinally extending ridges 234B are machined to comprise a plurality of circumferentially extending notches 236B longitudinally distributed thereon. Each pair of neighboring notches 236B thus form a circumferentially extending tooth 238B. The circumferentially extending notches 236B and teeth 238B form a plurality of discrete circles (interrupted by the grooves 232B) in parallel with each other.

In these embodiments, each of the pin 202 and the box 204 comprises six (6) grooves 232A/232B with a geometry thereof allowing the pin 202 to insert into the box 204 unhindered.

With above-described profile/geometry, the pin 202 and the box 204 may be efficiently manufactured by milling rather than using other costly and time-consuming manufacturing processes such as broaching or electro-discharge machining (EDM).

As shown in FIG. 10A, to assemble the near-bit sub 110, the pin 202 is first oriented in a vertical direction with the uphole end 216 at the bottom. A plurality of electrically insulating lock rollers 244 are then fitted into the pockets 242A of the pin 202. As the pockets 244 extend towards the uphole end 216, the lock rollers 244 fall into the pockets 242A and are substantially fully received therewithin.

Then, an electrically insulating ceramic ring 262 is received into the chamber 224A of the pin 202 against the shoulder 223A, and an electrically insulating washer or ring 264 such as a ceramic ring is put on top of the downhole end 222 of the pin 202. The electrically insulating ceramic ring 262 has a longitudinal length longer than the summation of the longitudinal lengths of the chamber 224A of the pin 202 and the chamber 224B of the box 204. Thus, the electrically insulating ceramic rings 262 and 264 form an electrically insulating spacing assembly for longitudinally separating the pin 202 and the box 204 from direct contact.

An electrically insulating seal sleeve 266 is also placed onto the downhole coupling section 218 of the pin 202 against the shoulder 220.

Figure 10B:
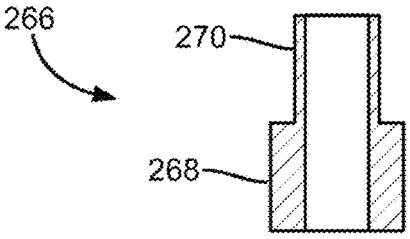
FIG. 10B is a schematic cross-sectional view of an electrically insulating seal sleeve for coupling the pin and the box shown in FIGS. 7 and 8, respectively, for forming the near-bit sub shown in FIG. 5.

FIG. 10B is a cross-sectional view of the electrically insulating seal sleeve 266. As shown, the seal sleeve 266 comprises an uphole portion 268 for acting as a spacer between the cylindrical body 210 of the pin 202 and the uphole end 216 of the box 204, and a downhole portion 270 having a reduced outer diameter and a longitudinal length equal to or shorter than that of the first portion 226A of the pin 202 for positioning radially between the first portion 226A of the pin 202 and the first portion 226B of the box 204 as a spacer for maintaining the concentricity of the pin 202 and the box 204. The seal sleeve 266 also provides a smooth and non-porous surface to seal against to prevent drilling fluid from entering the clearance gap 272 (see FIGS. 11A and 11B).

Referring again to FIG. 10A, the box 204 is aligned with the pin 202 such that the grooves 232B and ridges 234B of the box 204 are aligned with the ridges 234A and grooves 232A of the pin 202, respectively. Then, the aligned box 204 is moved onto the pin 202 such that the uphole coupling section 254 of the box 204 receives the downhole coupling section 218 of the pin 202 and the chamber 224B receives the ceramic ring 262. The ceramic ring 262 is thus received in the chambers 224A and 224B against the shoulders 223A and 223B, respectively, thereby maintaining the concentricity of the pin 202 and the box 204, and sealing therebetween.

As the longitudinal length of the ceramic ring 262 is longer than the summation of the longitudinal lengths of the chamber 224A of the pin 202 and the chamber 224B of the box 204, and as the inner surface profile of the uphole coupling section 254 of the box 204 is slightly larger than the outer surface profile of the downhole coupling section 218 of the pin 202, the pin 202 and the uphole coupling section 254 are not in direct contact with each other. After the pin 202 and the box 204 are full engaged, the pockets 242A of the pin 202 are aligned with the pockets 242B of the box 204 thereby forming a plurality of combined locking chambers (denoted using reference numeral 242).

Figure 11A:
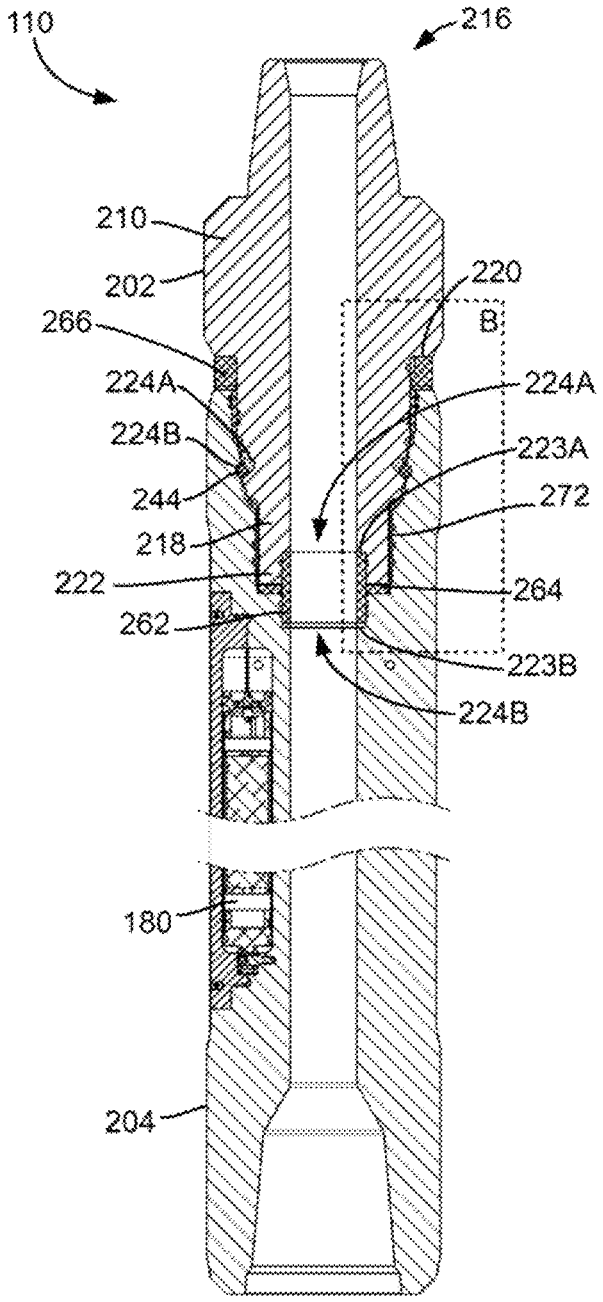
FIG. 11A is a cross-sectional view of the fully engaged pin and the box shown in FIGS. 7 and 8, respectively, during the assembling process of the near-bit sub shown in FIG. 5, wherein the plurality of locking rollers are at the interface between the pin and the box.
Figure 11B:
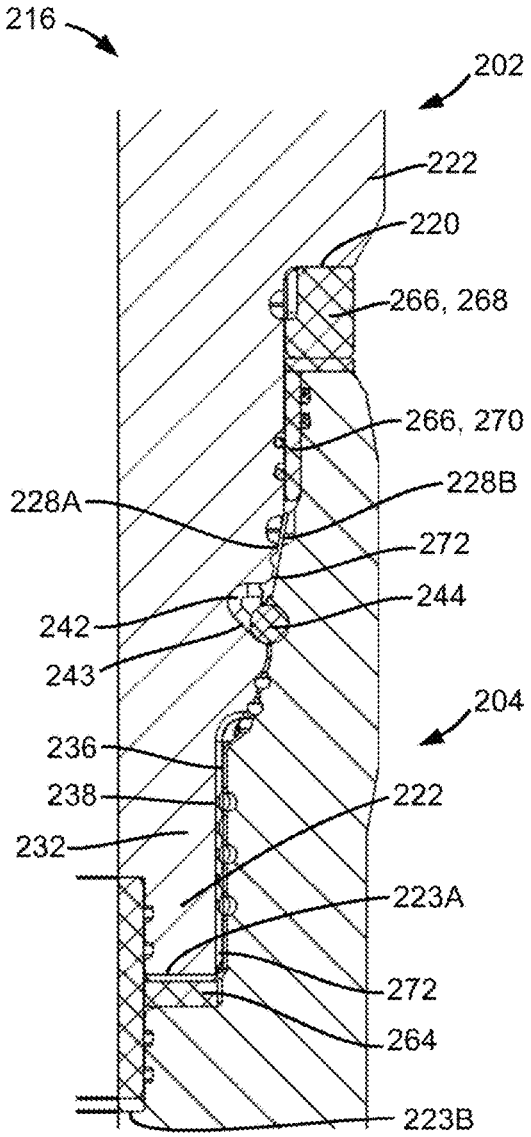
FIG. 11B is an enlarged cross-sectional view of a portion B of the fully engaged pin and the box shown FIG. 11A.

As shown in FIGS. 11A and 11B, the fully engaged pin 202 and box 204 are then re-oriented "upside-down" in a vertical direction with the pin 202 on top. Due to the gravity, the locking rollers 244 then move downwardly and partially fall into the pocket 242B of the box 204. As a portion of each locking roller 244 is still received in the pocket 242A of the pin 202, the locking rollers 244 are thus wedged between the two tapering or inclined surfaces of the pin 202 and the box 204 and prevent relative movement therebetween.

Figure 12A:
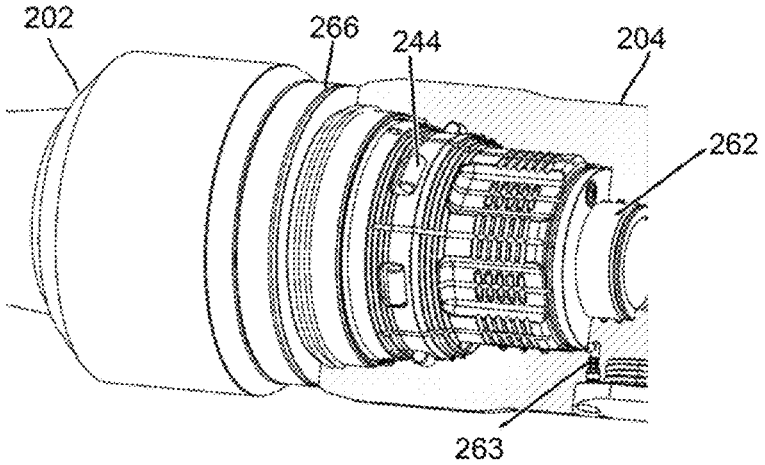
FIG. 12A is a partially perspective, partially cross-sectional view of the fully engaged pin and the box shown FIG. 11A, wherein a portion of the pin is shown in a perspective view and a portion of the box is shown in a cross-sectional view.
Figure 12B:
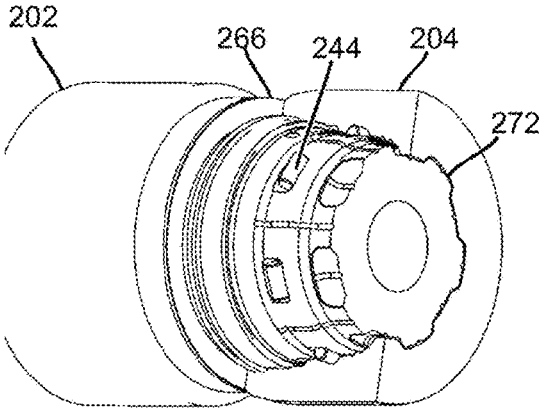
FIG. 12B is a partially perspective, partially cross-sectional view of the fully engaged pin and the box shown FIG. 11A, wherein a portion of the pin is shown in a perspective view and a portion of the box is shown in a perspective cross-sectional view.
Figure 12C:
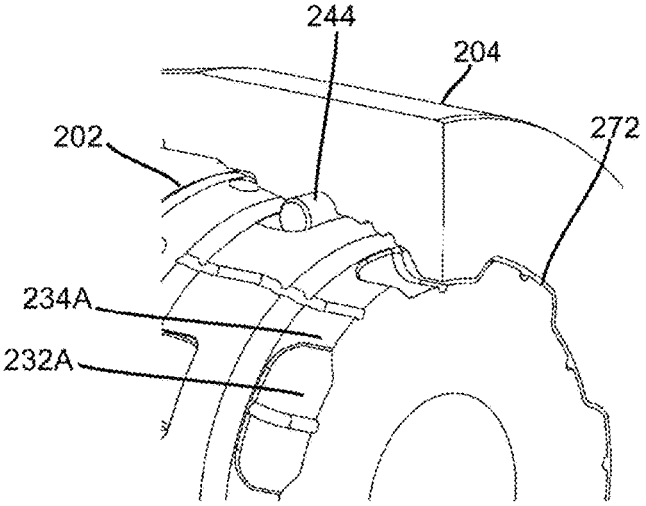
FIG. 12C shows an enlarged portion of FIG. 12B, showing the clearance gap between the pin and the box.

As described above, the geometry of the longitudinally extending ridges 234A and 234B and grooves 232A and 232B is designed in such a manner that it provides sufficient clearance gap 272 for the pin 202 to slide into the box 204 without contact. For example, in some embodiments, the clearance gap 272 between the pin 202 and the box 204 is about 0.040 inch to about 0.050 inch (about 1.02 mm to about 1.27 mm) after the pin 202 and the box 204 are fully engaged. Such a clearance gap 272 may be sufficient for maintaining the pin 202 and the box 204 in a non-touching proximity even with minor machining imperfections. FIGS. 12A to 12C show the fully engaged pin 202 and box 204 and the clearance gap 272 therebetween.

In a next assembling step, the clearance gap 272 is filled with an electrically insulating gap-filling material for example, a high-temperature-bearing plastic, a fiberglass epoxy, a thermosetting resin such as a two-part epoxy sufficiently mixed before injection and filling into the clearance gap 272, a thermosetting resin with ceramic microparticles, and/or the like. In some embodiments, the gap-filling material, when set, has sufficient structural strength such as sufficiently high compressive strength, at intended downhole operating temperatures.

The fully engaged pin 202 and box 204 may be temporarily secured onto a fixture to prevent axial relative movement between the pin 202 and the box 204. To best achieve a complete and homogenous filling of the clearance gap 272, a vacuum pump may be used to first evacuate the air in the clearance gap 272. Then, the clearance gap 272 is filled with the electrically insulating material such as a sufficiently-mixed electrically insulating thermosetting resin via an injection port 263 (see FIG. 12A) under a low pressure. For example, a pressure of 40 to 60 pounds per inch (psi) (2.76 to 4.14 Bars) is often sufficient to force the epoxy fluid with a relatively low-mixed viscosity to flow through the clearance gap 272 and into the channels 240, the space of the combined locking chamber 242 (formed by the pockets 242A and 242B) unoccupied by locking rollers 244, and circumferential notches 236A, 236B, and 237 of the pin 202 and the box 204. A time/temperature cure schedule may be required based on the formulation of the thermosetting resin to allow the gap-filling resin to set with optimum strength.

After set, the gap-filling resin in the combined locking chamber 242 secures the locking rollers 244 in place at the interface radially between the pin 202 and the box 204. The grooves 232A of the pin 202 are interlocked with the ridges 234B of the box 204, and the grooves 232B of the box 204 are interlocked with the ridges 234A of the pin 202. The interlocked grooves/ridges 232A/234B and 232B/234A are secured by the set gap-filling resin filled in the clearance gap 272 therebetween, the channels 240, and circumferential notches 236A, 236B, and 237 of the pin 202 and the box 204. Moreover, the gap-filling resin in the channels 240, and circumferential notches 236A, 236B, and 237 of the pin 202 and the box 204 form a reinforcement structure for improving the strength of the near-bit sub 110. For example, the set gap-filling resin in the circumferential notches 236A, 236B, and 237 of the pin 202 and the box 204 form a molded-resin circular locking-rings for locking the engaged pin 202 and box 204 in position.

The geometry of the grooves 232A of the pin 202 ensures improved bond and retention of the resin with a maximized surface area in critical orientation for preventing crushing of the resin when the near-bit sub 110 is under torque during downhole use.

Those skilled in the art will appreciate that the pin 202 and box 204 may comprise a plurality of seal glands for receiving therein a plurality of O-rings and/or the like for sealing the near-bit sub 110 against high-pressure downhole drilling mud.

In some embodiments, an electrically insulating elastomer sleeve (not shown) such as a rubber sleeve may be molded onto the assembled near-bit sub 110 for further enhancing seal performance and for producing a longer electrically insulating exterior surface gap. In some embodiments, an electrically insulating ceramic sleeve (not shown) may be further installed over the elastomer sleeve for protecting the elastomer sleeve from erosion caused by the high-velocity drilling mud flowing outside the near-bit sub 110. The ceramic sleeve may be segmented for ease of manufacturing and for relieving bending stresses as the drill-string is operated in a curved wellbore.

As described above, the pin 202 and the box 204 comprise a plurality of geometry features including tapering or conical surfaces 228A and 228B, flow notches such as notches 236A, 236B, and 237, and inclined sidewall of the pocket 242A (described later). These geometry features, in combination with the gap-filling resin and the locking rollers 244, prevents axial displacement of the pin 202 and the box 204, and maintains the integrity of the gap connection under axial tension and/or axial compression.

For example, referring again to FIG. 11B, the pocket 242A of the pin 202 has an inclined radial extension towards the uphole end 216. Consequently, the pocket 242A of the pin 202 comprises an inclined sidewall 243 facing radially outwardly and longitudinally to the uphole end 216. When the pin 202 fully engages the box 204 and when the locking roller 244 has positioned at the interface between the pin 202 and the box 204, and has been secured therein by the set resin, the inclined sidewall 243 of the pocket 242A supports the locking roller 244 seating thereon against any axial displacement forces that may otherwise separate the pin 202 and the box 204, thereby maintaining the integrity of the gap connection under axial tension.

The tapering or conical surfaces 228A and 228B of the pin 202 and the box 204, respectively, and the gap-filling resin in the clearance gap 272 therebetween support the pin 202 and the box 204 against axial compression thereby maintaining the integrity of the gap connection.

Moreover, as the clearance gap 272 is filled with an electrically insulating thermosetting resin or thermoplastic fluid which, once set or hardened, forms a rigid electrically insulating layer connecting the pin 202 and the box 204, the pin 202 and the box 204 then form two dipole segments and may be used as a dipole antenna of the near-bit sub 110. Such a near-bit sub 110 is suitable for withstanding the drilling conditions and parameters such as high axial compression and/or tension load, bending moments, excessive wear, and/or the like.

Conventional insulated gap connections are often formed by engagement of helical threads and require an intricate and delicate process to assemble the two halves in order to accurately and symmetrically form the insulating gap. Such an assembling process is time-consuming and prone to human error which may result in defected products. Compared to conventional insulated gap connections, the gap connection of the near-bit sub 110 described herein provides a simple installation process and overcomes the difficulties experienced with conventional insulated gap connections.

In above embodiments, each of the pin 202 and the box 204 comprises six (6) grooves 232A/232B. In some alternative embodiments, each of the pin 202 and the box 204 may comprise a different number of grooves 232A/232B.

In some alternative embodiments, the electrically insulating rings 262 and 264 may be made of any suitable electrically insulating material such as rubber or plastic.

In some alternative embodiments, the electrically insulating rings 262 and 264 may be integrated as a single ring having a section corresponding to the ring 262 and another section corresponding to the ring 264.

In some embodiments, the near-bit sub 110 does not comprise the electrically insulating ring 264. The space between the downhole end 222 of the pin 202 and the uphole end 216 of the box 204 (that was occupied by the ring 264 as shown in FIGS. 10A, 11A and 11B), is filled with the gap-filling material.

Figure 13:
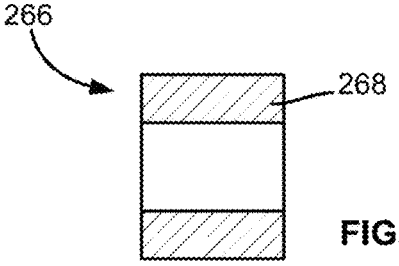
FIG. 13 is a cross-sectional view of an electrically insulating or an electrically non-conductive seal sleeve for coupling the pin and the box shown in FIGS. 7 and 8, respectively, for forming the near-bit sub shown in FIG. 5, according to some embodiments of this disclosure.

In some embodiments as shown in FIG. 13, the seal sleeve 266 is an electrically insulating ring without the downhole portion 270.

Figure 14:
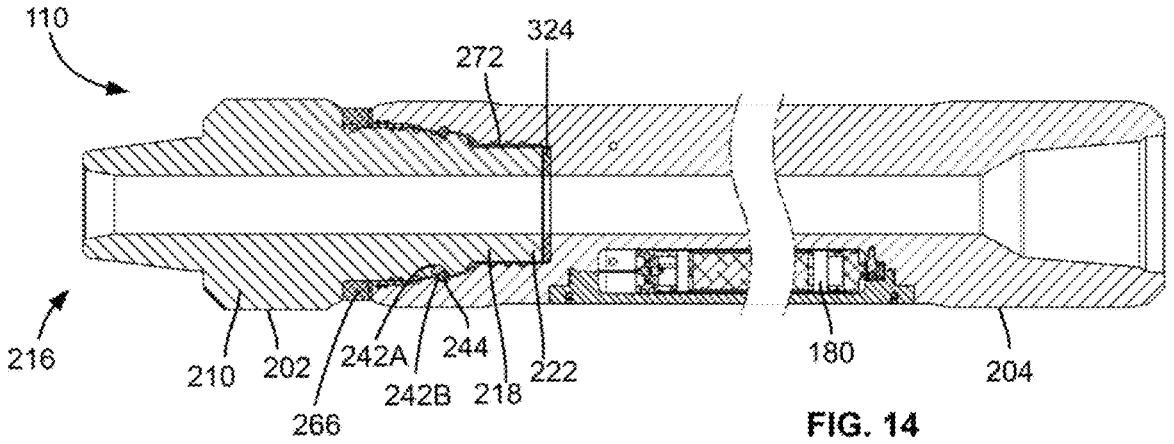
FIG. 14 is a cross-sectional view of the near-bit sub shown in FIG. 5, according to some embodiments of this disclosure.

In some embodiments as shown in FIG. 14, the pin 202 and the box 204 do not comprise any chamber 224A, 224B for receiving the electrically insulating ring 262. Consequently, the near-bit sub 110 does not comprise any electrically insulating ring 262. Rather, the near-bit sub 110 in these embodiments only comprises an electrically insulating ring 282 at the downhole end 222 thereof.

In above embodiments, the above-described pin/box structure is used for the near-bit sub 110 for forming a gap connection. In some alternative embodiments, such a pin/box structure may also be used in other subs such as a gap sub, a gap joint of a telemetry probe, and the like which may require a robust, sealed, and electrically insulating gap connection in a conductive conduit.

One-Piece Near-Bit Sub Having an Electrically Insulating Sleeve and Spring-Loaded Electrical-Contact Pads In some embodiments as shown in FIGS. 15A to 15D, the near-bit sub 110 is a one-piece sub having an electrically-insulated sleeve and spring-loaded electrical-contact pads.

As shown, the near-bit sub 110 in these embodiments comprises an electrically conductive metal sub body 302 having a longitudinal central bore 304 extending therethrough from a downhole end 306 to an uphole end 308 thereof for fluid communication between the mud motor 112 and the drill bit 108. The sub body 302 comprises therein one or more chambers or pockets circumferentially about the longitudinal central bore 174 for accommodating therein the data measurement and transmission components 132. Each chamber 180 is sealably closed by a cover 182.

The near-bit sub 110 in these embodiments uses a gapped ring structure for forming a dipole antenna. As shown, the electrically conductive sub body 302 comprises an electrically conductive sleeve 312 electrically insulated therefrom by an electrically insulating layer 313. The sleeve 312 comprises a plurality of (such as three) spring-loaded electrical-contact pads 314 pivotably mounted thereon.

Each electrical-contact pad 314 has a profile curved towards the radial center of the sub body 302 and is coupled to a spring (not shown) for radially outward biasing, and may be rotatable radially inwardly under an external force. The electrically conductive metal sub body 302 and the electrical-contact pads 314 thus form an antenna. During a wellbore drilling process, the spring of each electrical-contact pad 314 forces the electrical-contact pad 314 to contact the formation for transmitting EM signals.

Those skilled in the art will appreciate that, in some alternative embodiments, the one-piece sub structure with an electrically-insulated spring-loaded padded sleeve may also be used in other subs such as a gap sub, a gap joint of a telemetry probe, and the like which may require a robust, sealed, and electrically insulating gap connection in a conductive conduit.

Mud-Activated Power Generator

Figure 16A:
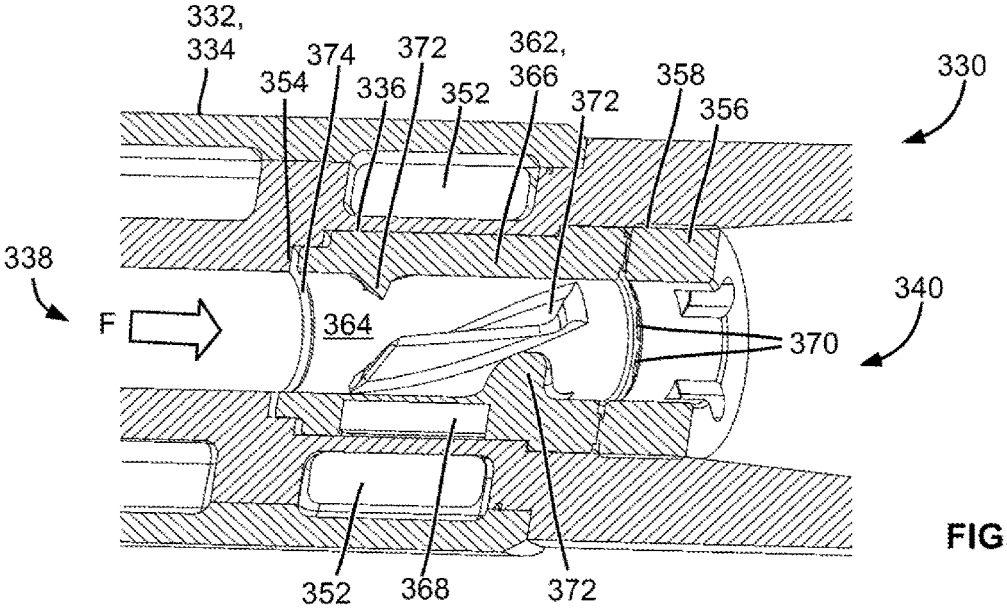
FIGS. 16A to 16C are a perspective cross-sectional view, a front view, and a rear view of a portion of a mud-activated power generator, respectively.
Figure 16B:
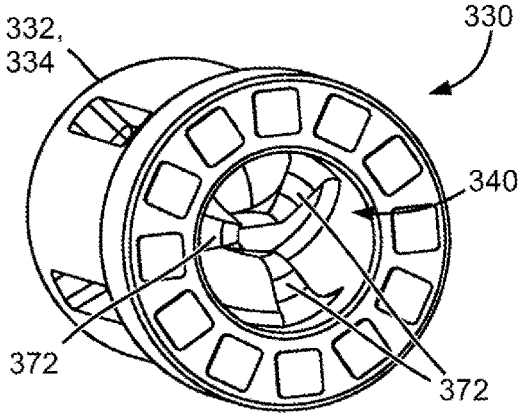
Figure 16C:
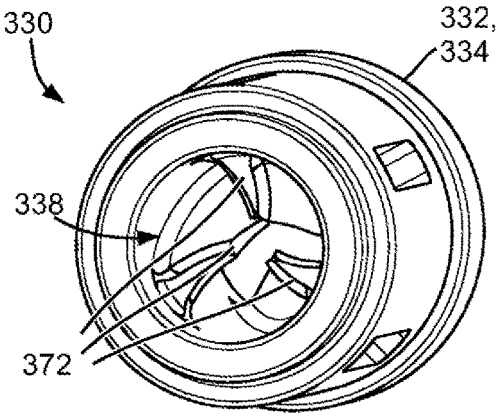

In some embodiments, a mud-activated power generator is used for generating electrical power for the electrical components of the BHA 100. As shown in FIGS. 16A to 16C, the mud-activated power generator 330 comprises a housing 332 having a sidewall 334 that forms a chamber 336 in fluid communication with two longitudinally opposite ports 338 and 340. The sidewall 334 comprises therein one or more pockets 352 circumferentially about the chamber 336. Each pocket 352 receives therein one or more coils (not shown) for generating electrical power.

In these embodiments, the chamber 336 is defined between a downhole-facing circumferential shoulder 354 and a ring 356 removably mounted to the inner surface of the sidewall 334 by using threads 358 at a distance downhole from the shoulder 354. The ring 356 is made of a hard material such as tungsten carbide or ceramic.

A rotor 362 is rotatably received in the chamber 336. In these embodiments, the rotor 362 has a length slightly shorter than that of the chamber 336 for facilitating the rotation of the rotor 362.

The rotor 362 is in a substantively cylindrical shape with a longitudinal bore 364 extending therethrough. The rotor 362 also comprises one or more pockets 368 in sidewall 366 thereof. Each pocket 368 receives therein one or more magnets (not shown). The rotor 362 further comprises a plurality of buttons 370 made of a hard material such as tungsten carbide or ceramic on the downhole end thereof. The ring 356 also comprises a plurality of buttons (not shown) made of a hard material on the uphole end thereof for engaging the buttons 370 of the rotor 362.

One or more propeller blades 372 extend from the inner surface of the rotor 362 radially inwardly and longitudinally at an acute angle with respect to an axis of the rotor 362. Each propeller blade 372 has a suitable shape for being driven by a fluid flow F to rotate the rotor 362.

In operations such as during a drilling process, a mud flow F such as a drilling mud flow is injected downhole into the chamber 336 and the bore 364 of the rotor 362. The mud flow F presses the rotor 362 against the ring 356 via the buttons 370 and drives the blades 372 to rotate the rotor 362. As the length of the rotor 362 is slightly shorter than that of the chamber 336, a small gap 374 is maintained between the shoulder 354 and the rotor 362 for facilitating the rotation of the rotor 362. The buttons 370 slidably engage the ring 356 and act as a friction bearing between the rotor 362 and the ring 356 during operation.

The rotation of the rotor 362 and the magnets in the pockets 368 thereof generates a rotating magnetic field ranging through the coils in the pockets 352. As a result, electrical power is generated in the coils and is output to power the electrical components (not shown) connected thereto.

As described above, the pin/box structure may be used in any sub such as a near-bit sub, a gap sub, a gap joint of a telemetry probe, and the like which may require a robust, sealed, and electrically insulating gap connection in a conductive conduit. In the following, a sub having a pin/box structure is generally denoted as a gapped apparatus for ease of description.

Some Embodiments of Gapped Apparatus

In some embodiments, the pin 202 and/or the box 204 may be coated with an electrically insulating material such as plastic, polyether ether ketone (PEEK), ceramic, and/or the like for further improving the electrical insulation therebetween.

For example, in some embodiments, the pin 202 and/or the box 204 may be coated with ceramic for further improving the electrical insulation therebetween. However, as it may be more difficult to coat the profile on the inner surface of the box 204, it may be more preferable to only coat the pin 202 with ceramic.

In some embodiments, either the pin 202 or the box 204 comprises a plurality of spring-loaded electrical-contact pads for electrically contacting the formation or subsurface earth.

Figure 17:
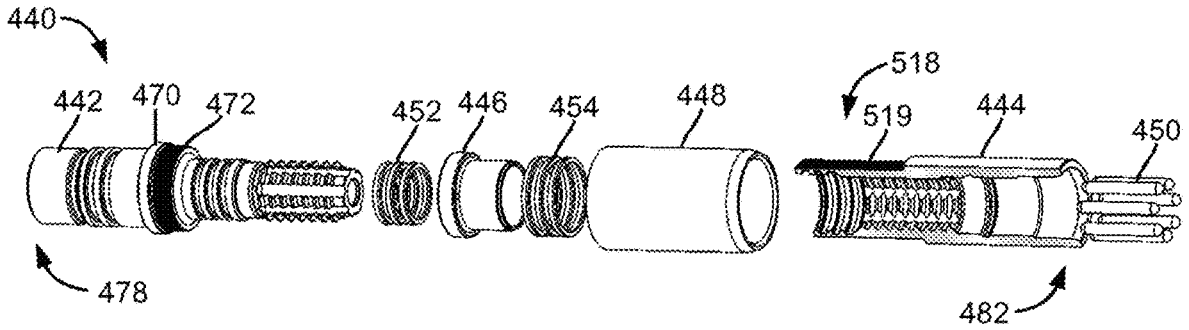
FIG. 17 is an exploded view of a gapped apparatus, according to some embodiments of this disclosure.

In some embodiments as shown in FIG. 17, a gapped apparatus 440 comprises two electrically conductive metal parts including a pin or shaft 442 and a box or housing 444 coupled together but electrically insulated thereby forming an electrical gap therebetween (other parts will be described later).

Figure 18A:
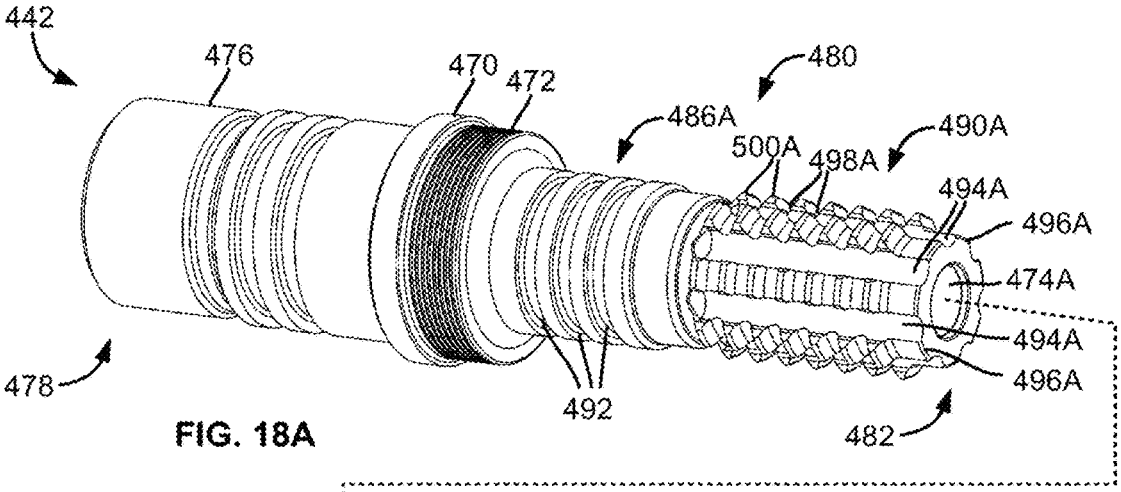
FIGS. 18A and 18B are a perspective view and a cross-sectional view of a pin and a box of the gapped apparatus shown in FIG. 17, respectively.

As shown in FIG. 18A, the pin 442 comprises a cylindrical body 470 having a longitudinal central bore 474A extending therethrough, an uphole coupling section 476 extending from the cylindrical body 470 to an uphole end 478 of the pin 442 and having threads (not shown) on the inner surface thereof for coupling to another sub, and a downhole coupling section 480 extending from the cylindrical body 470 to a downhole end 482 of the pin 442 for coupling to the box 444. The cylindrical body 470 comprises circumferential notches 472 on the outer surface thereof for coupling the pin 442 to a protection sleeve 448 (see FIG. 17) using a suitable bonding material such as a thermosetting resin, a high-temperature-bearing plastic, a thermosetting resin with ceramic micro-particles, a fiberglass epoxy, and/or the like.

The downhole coupling section 480 has a smaller outer diameter than that of the cylindrical body 470 and has a profile on the outer surface thereof formed by a cylindrical first portion 486A extending from the cylindrical body 470 to a cylindrical second portion 490A adjacent the downhole end 482. Unlike the pin 202 shown in FIG. 7, the downhole coupling section 480 of the pin 442 in these embodiments does not comprise any portion with a tapering outer surface.

The first portion 486A comprises one or more circumferential recesses 492 for receiving one or more sealing rings 452 (see FIG. 17). The second portion 490A is machined to comprise a plurality of longitudinally extending grooves 494A longitudinally extending to the downhole end 482 and circumferentially distributed on the outer surface thereof about the longitudinal central bore 494A. Each groove 494A has a half-circular cross-section. Each pair of neighboring grooves 494A thus form a ridge 496A.

The longitudinally extending ridges 496A are machined to comprise a plurality of circumferentially extending notches 498A longitudinally distributed thereon. Each pair of neighboring notches 498A thus form a circumferentially extending tooth 500A. The circumferentially extending notches 498A and teeth 500A form a plurality of discrete circles (interrupted by the grooves 494A) in parallel with each other.

Figure 18B:
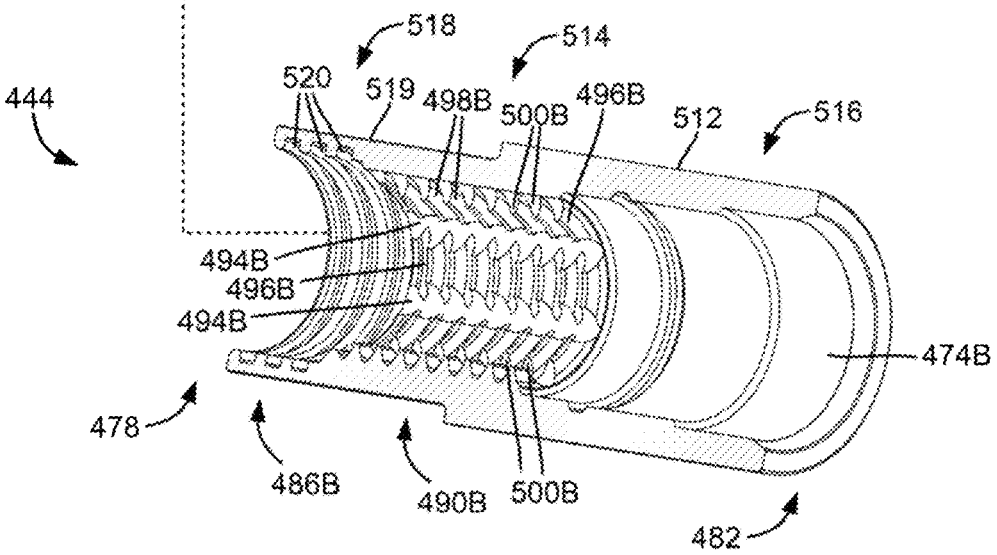

As shown in FIG. 18B, the box 444 comprises a cylindrical body 512 having a longitudinal central bore 474B extending therethrough. The cylindrical body 512 comprises an uphole coupling section 514 adjacent an uphole end (also identified using reference numeral 478) for coupling to the pin 442 and a downhole coupling section 516 adjacent a downhole end (also identified using reference numeral 482) and comprising threads (not shown) on the inner surface thereof for coupling to another sub. The central bore 474B in the downhole coupling section 516 has an inner diameter greater than that of the central bore 474B in the uphole coupling section 514. Moreover, the inner diameter of the central bore 474B in the uphole coupling section 514 is larger than the outer diameter of the downhole coupling section 480 such that a portion of an electrically insulating seal sleeve 446 (see FIG. 17, the seal sleeve 446 having a structure similar to that of the seal sleeve 266 shown in FIG. 10) may be radially sandwiched between the pin 442 and the box 444 as an electrical insulation spacer.

A coupling portion 518 of the uphole coupling section 514 adjacent the uphole end 478 has a reduced outer diameter and comprises circumferential notches 519 on the outer surface thereof for coupling the box 444 to the protection sleeve 448 (see FIG. 17) with a suitable bonding material such as a thermosetting resin, a high-temperature-bearing plastic, a thermosetting resin with ceramic micro-particles, a fiberglass epoxy, and/or the like.

On the inner surface thereof, the uphole coupling section 514 comprises a profile substantively matching that of the downhole coupling section 480 of the pin 442 such that the downhole coupling section 480 of the pin 442 may be received in the uphole coupling section 514 of the box 444 with a clearance gap therebetween. In particular, the inner surface of the uphole coupling section 514 comprises a cylindrical first portion 486B extending from the uphole end 478 to a cylindrical second portion 490B.

The cylindrical first portion 486B comprises one or more circumferential recesses 520 for receiving therein one or more sealing rings 454 (see FIG. 17). The second portion 490B is machined to comprise a plurality of longitudinally extending grooves 494B circumferentially distributed on the inner surface thereof. Each groove 494B has a half-circular cross-section. Each pair of neighboring grooves 494B form a ridge 496B. The grooves 494B and ridges 496B of the box 444 are suitable for engaging the corresponding ridges 496A and grooves 494A of the pin 442 without direct contact.

The longitudinally extending ridges 496B are machined to comprise a plurality of circumferentially extending notches 498B longitudinally distributed thereon. Each pair of neighboring notches 498B thus form a circumferentially extending tooth 500B. The circumferentially extending notches 498B and teeth 500B form a plurality of discrete circles (interrupted by the grooves 494B) in parallel with each other. Moreover, the circumferentially extending notches 498B and teeth 500B on the longitudinally extending ridges 496B of the box 444 are sized and positioned for engaging the corresponding teeth 500A and notches 498A of the pin 442 without direct contact, when the pin 442 and the box 444 are assembled together.

In these embodiments, each of the pin 442 and the box 444 comprises seven (7) grooves 494A/494B with a geometry thereof allowing the pin 442 to insert into the box 444 unhindered.

With above-described profile/geometry, the pin 442 and the box 444 may be efficiently manufactured by milling rather than using other costly and time-consuming manufacturing processes such as broaching or EDM.

Referring again to FIG. 17, to assemble the gapped apparatus 440, sealing rings 452 are fitted into the recesses 492 of the pin 442 and sealing rings 454 are fitted into the recesses 520 of the box 444. Then, the coupling portion 518 of the box 444 is painted with a bonding material in a liquid form and is inserted into the protection sleeve 448.

The electrically insulating seal sleeve 446 is placed onto the downhole coupling section 480 of the pin 442 against the cylindrical body 470 thereof. The notches 472 of the pin 442 are painted with a bonding material in a liquid form.

The pin 442 is aligned with the box 444 such that the grooves 494A and ridges 496A of the pin 442 are aligned with the ridges 496B and grooves 494B of the box 444, respectively. The aligned pin 442 is then inserted through the protection sleeve 448 into box 444, wherein the ridges 496A of the pin 442 are received into the grooves 494B of the box 444, and the ridges 496B of the box 444 are received into the grooves 494A of the pin 442.

After the uphole end 478 of the box 444 is in contact with the seal sleeve 446, the pin 442 is fully inserted into the box 444. Then, the pin 442 or the box 444 is rotated clockwise or counterclockwise for an angle $\alpha$ such that the longitudinally extending grooves 494A and 494B of the pin 442 and the box 444 are circumferentially overlapped, thereby forming a plurality of cylindrical chambers (denoted using reference numeral 494). The angle $\alpha$ is calculated as $360°/(2N)$ wherein N is the number of grooves 494A or 494B. For example, in these embodiments, N=7 and the angle $\alpha$ is about 26°.

The longitudinally extending ridges 496A and 496B of the pin 442 and the box 444 are also circumferentially overlapped such that the circumferentially extending teeth 500A are received in respective notches 498B and the circumferentially extending teeth 500B are received in respective notches 498A, all without direct contact with each other.

Referring to FIGS. 17 and 19 to 21, a plurality of elongated keys 450 are painted with a bonding material in a liquid form and are inserted into the chambers 494 from the downhole end 482 of the box 444. The elongated keys 450 are made of an electrically insulating material with a high-shear strength such as glass-filled PEEK for providing sufficient robustness for transmission of torque from the pin 442 to the box 444. The shape of the elongated keys 450 generally matches the shape of the chambers 494. As the chambers 494 are of a cylindrical shape, the elongated keys 450 have a matching cylindrical shape, thereby easy to manufacture.

Figure 19:
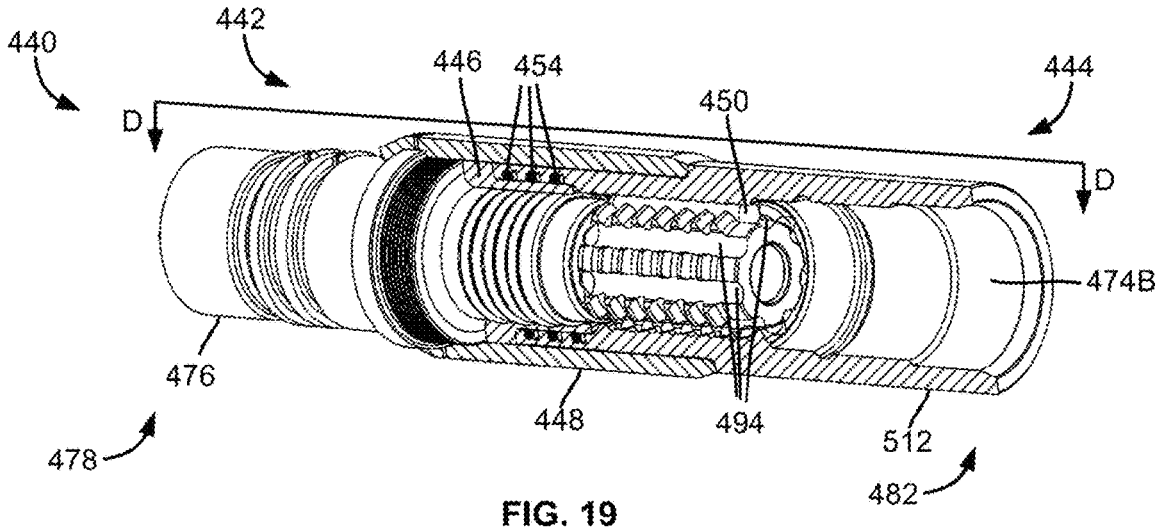
FIG. 19 is a partially perspective, partially cross-sectional view of the fully engaged pin and the box shown FIGS. 18A and 18B forming the gapped apparatus, wherein the pin is shown in a perspective view and the box is shown in a perspective cross-sectional view.
Figure 20:
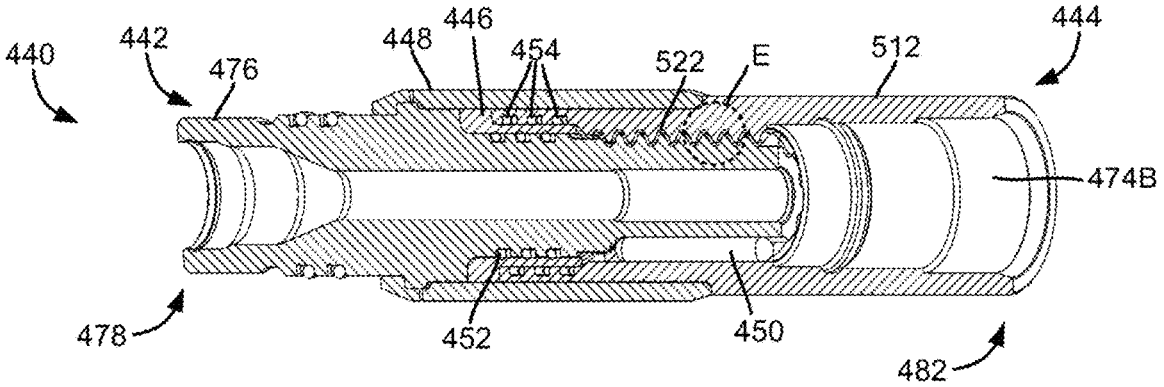
FIG. 20 is a perspective cross-sectional view of the gapped apparatus shown in FIG. 19 along the cross-sectional line D-D.
Figure 21:
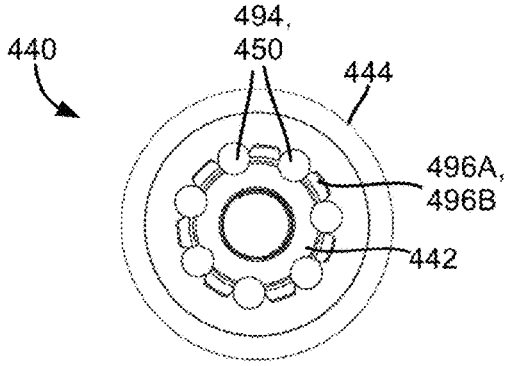
FIG. 21 is a front view of the gapped apparatus shown in FIG. 19.
Figure 22:
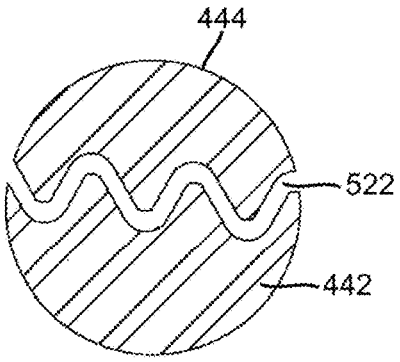
FIG. 22 shows an enlarged portion E of FIG. 20.

As shown in FIGS. 20 and 22, there exists a clearance gap 552 between the overlapped portions of the pin 442 and box 444. In these embodiments, the clearance gap 552 is between about 0.040 inch and about 0.050 inch (about 1.02 mm to about 1.27 mm). The clearance gap 552 is then filled with an electrically insulating gap-filling material as described above. FIGS. 19 to 21 show the assembled gapped apparatus 440.

In above embodiments, the elongated keys 450 are cylinders having a same circular cross-sectional shape. In some alternative embodiments, the elongated keys 450 may have other suitable cross-sectional shapes such as a rectangle, an ellipse, a round-corner rectangle, or the like.

In some embodiments as shown in FIGS. 23 to 27, a gapped apparatus 600 comprises two electrically conductive metal parts including a pin 602 and a box 604 coupled together but electrically insulated thereby forming an electrical gap therebetween.

Figure 26:
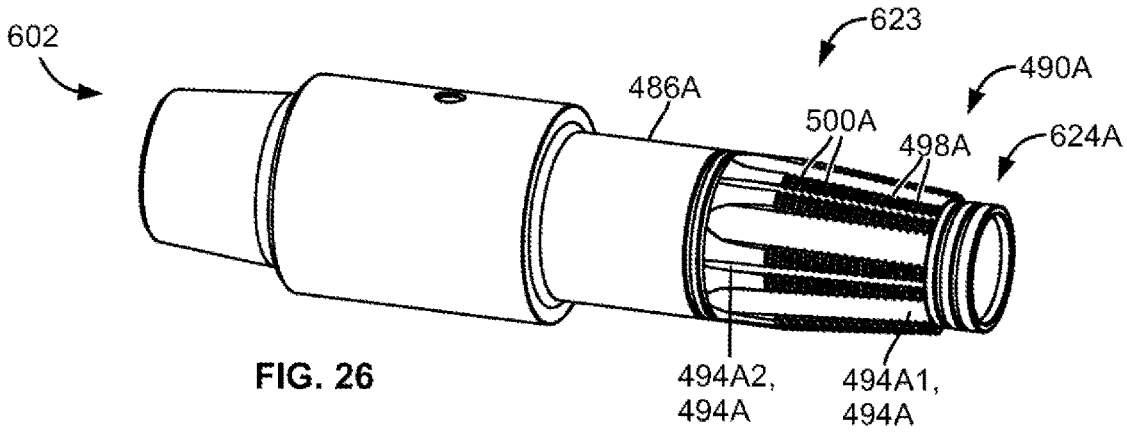
FIG. 26 is a perspective view of a pin of the gapped apparatus shown in FIG. 23.

As shown in FIG. 26, the pin 602 comprises a cylindrical body 622 and a downhole coupling section 623. The downhole coupling section 623 which is similar to the downhole coupling section 480 of the pin 442 shown in FIGS. 17 to 21. However, the second portion 490A of the downhole coupling section 623 in these embodiments has a tapering profile and the downhole coupling section 623 further comprises a cylindrical third portion 624A having one or more circumferential notches for receiving therein one or more sealing rings. Moreover, the longitudinal extending grooves 494A (including grooves 494A1 with wider width and grooves 494A2 with narrower width) on the second portion 490A have different cross-sectional shapes. For example, the longitudinally extending grooves 494A1 may have a half round-corner rectangular cross-sectional shapes, while the longitudinally extending grooves 494A2 may have a half-circular shape.

Figure 27:
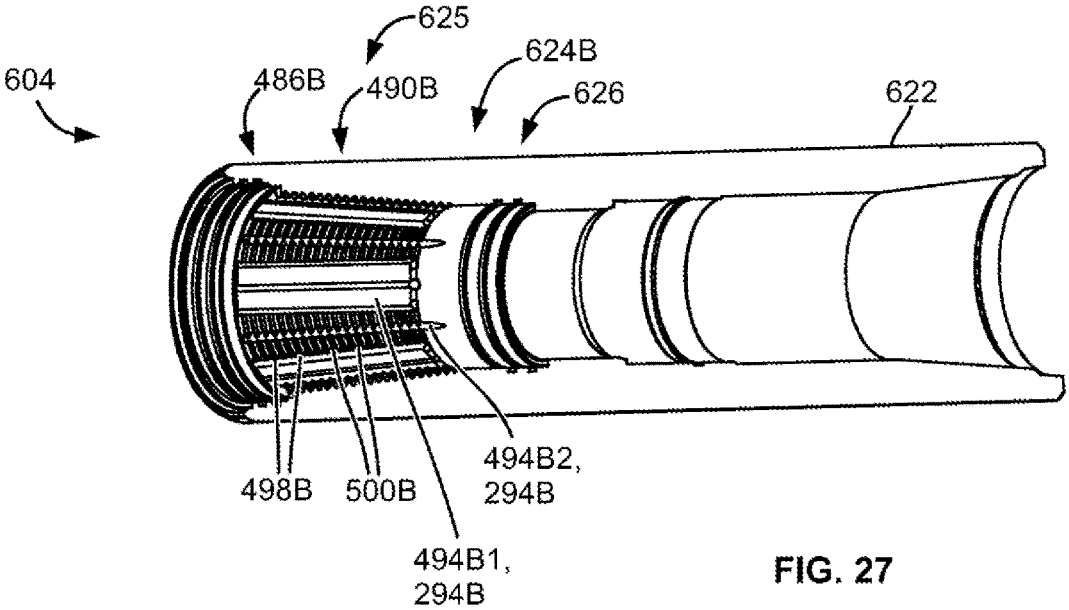
FIG. 27 is a perspective view of a box of the gapped apparatus shown in FIG. 23.

As shown in FIG. 27, correspondingly, the box 604 also comprises a cylindrical third portion 624B extending downhole from the second portion 490B, and a chamber 626 extending downhole from the third portion 624B. The longitudinal extending grooves 494B (including grooves 494B1 with wider width and grooves 494B2 with narrower width) on the second portion 490B have different cross-sectional shapes. For example, the longitudinally extending grooves 494B1 may have a half round-corner rectangular cross-sectional shapes, while the longitudinally extending grooves 494B2 may have a half-circular shape.

In these embodiments, the cylindrical first portion 486A of the pin 602 has a longer length than that of the cylindrical first portion 486B of the box 602.

Figure 23:
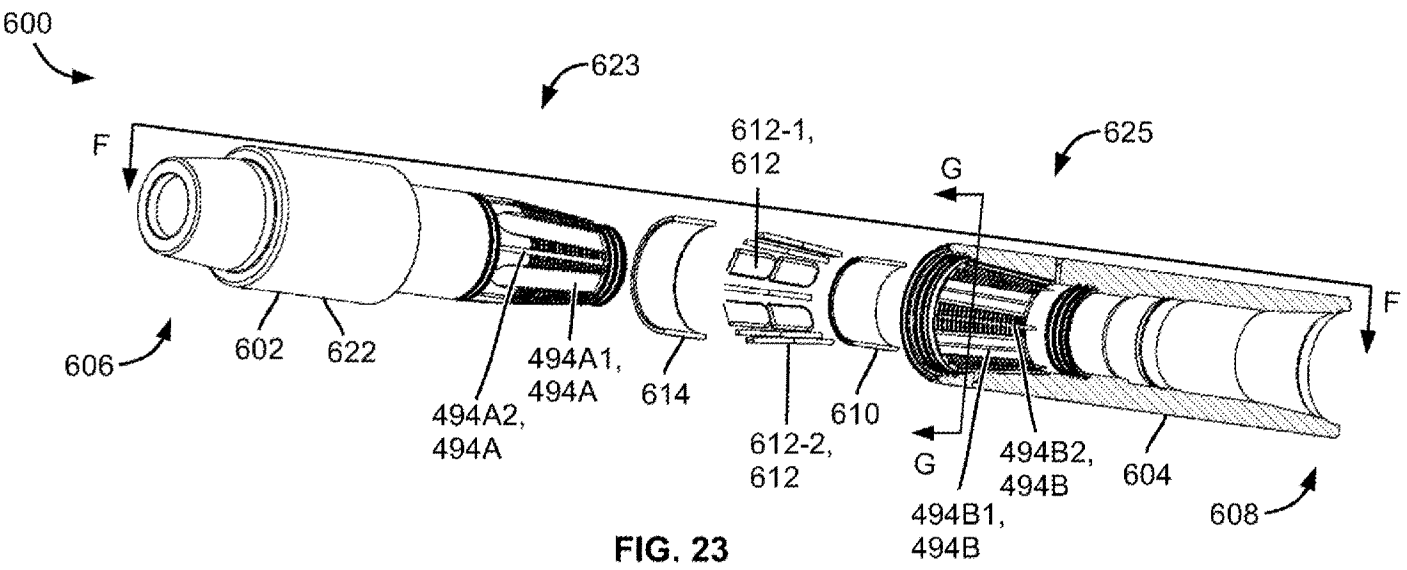
FIG. 23 is an exploded view of a gapped apparatus, according to some embodiments of this disclosure.
Figure 24:
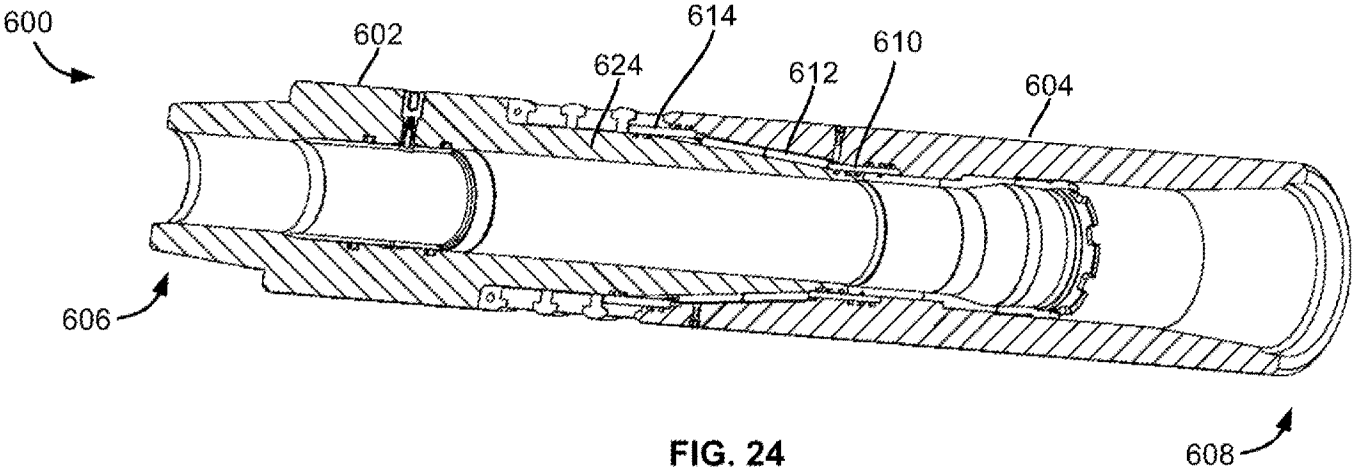
FIG. 24 is a cross-sectional view of the gapped apparatus shown in FIG. 23 along the cross-sectional line F-F.
Figure 25:
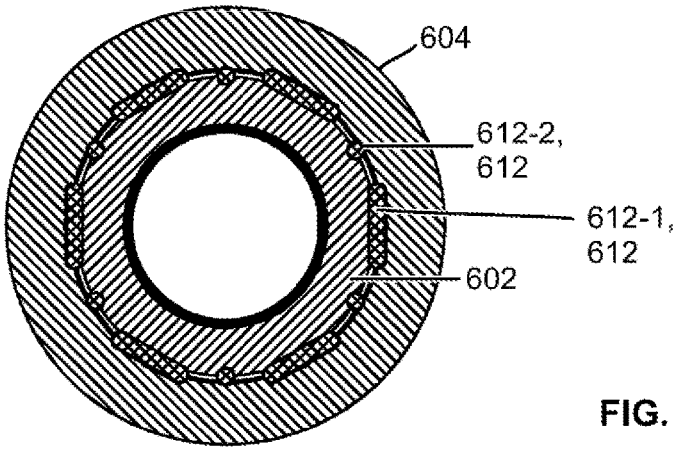
FIG. 25 is a cross-sectional view of the gapped apparatus shown in FIG. 23 along the cross-sectional line G-G.

Referring to FIGS. 23 and 24, to assemble the gapped apparatus 600, an electrically insulating seal sleeve 610 having one or more seal rings thereon is placed in the chamber 626. Then, the downhole coupling section 623 of the pin 602 is aligned with the uphole coupling section 625 of the box 604 and is then inserted thereinto. Similar to the assembling of the gapped apparatus 440, the pin 602 or the box 604 is turned or rotated such that the grooves 494A of the pin 602 and the corresponding grooves 494B of the box 604 are circumferentially overlapped.

The gapped apparatus 600 uses a plurality of electrically insulating keys 612-1 and 612-2 (collectively denoted as 612) or spacers for filling the grooves 494A and 494B, wherein the keys 612 have shapes matching the shapes of corresponding grooves 494A and 494B. As the grooves 494A and 494B have different cross-sectional shapes, the keys 612 also have different cross-sectional shapes. For example, keys 612-1 have a plate shape for filling the grooves 494A1 and 494B1, and keys 612-2 have a cylindrical shape for filling the grooves 494A2 and 494B2. Keys 612-1 and 612-2 may be made of an electrically insulating material such as fiberglass epoxy, ceramic, or the like. However, keys 612-2 are generally required to have a high strength such as made of ceramic for bearing rotational load and allowing the keys 612-1 to be made of a lower-cost material such as fiberglass epoxy.

Unlike the gapped apparatus 440 shown in FIGS. 19 and 20 in which the elongated keys 450 are inserted into the grooves 494 from the downhole end 482, the keys 612 in these embodiments are painted with a bonding material and are inserted into the grooves 494 from an uphole end 606 of the box 604. For ease of insertion, each key 612 may have a short length and each groove 494 may receive a plurality of keys 612 therein.

After the keys 612 are inserted into the grooves 494, a sleeve 614 that is pre-installed onto the pin 602 is then shifted towards the box 604 to engage the keys 612 to secure the keys 612 in place. Similar as the embodiments above, a gap-filling material may be injected into the circumferentially extending notches 498A of the pin 602 and the box 604.

In some alternative embodiments, the second portions 490A and 290B may also comprise one or more pockets 242A and 242B, respectively, as described above.

In some alternative embodiments, the second portions 490A and 290B may also comprise one or more pockets 242A and 242B, respectively, as described above. However, the gapped apparatus 600 in these embodiments does not use any keys 612 for inserting into the grooves 494. Rather, the grooves 494 are only filled with the gap-filling material.

In above embodiments, each of the pin and box only comprises one row of pockets 242A and 242B distributed on the tapering profile portions thereof. Each row of pockets 242A or 242B are on a same plane. In some alternative embodiments, each of the pin and box may comprise more than one row of pockets 242A and 242B distributed on the tapering profile portions thereof.

Figure 28:
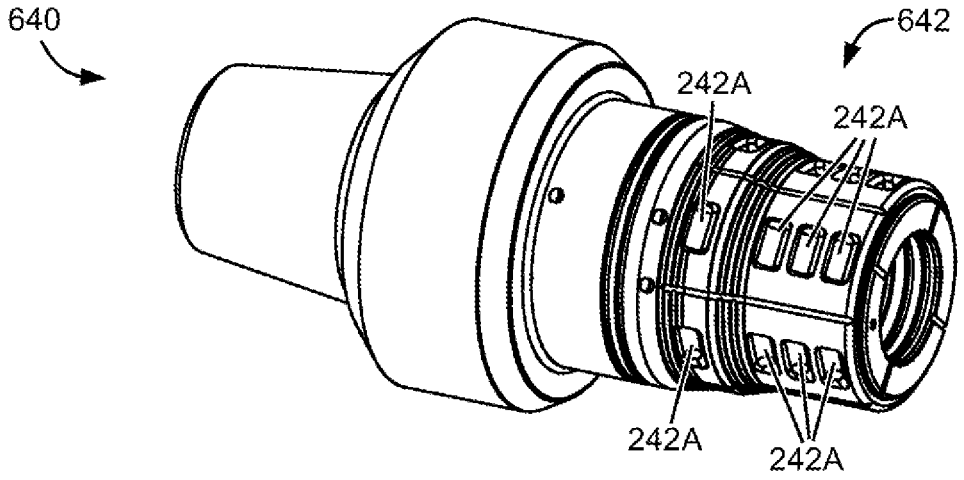
FIG. 28 is a perspective views of a pin, according to some embodiments of this disclosure.

FIG. 28 shows a pin 640 in some embodiments. The pin 640 is similar to the pin 202 shown in FIG. 7. However, the downhole coupling section 218 of the pin 640 in these embodiments only comprises a plurality of pockets 242A, and do not comprise any longitudinally extending ridges and grooves. The downhole coupling section 218 of the pin 640 may also comprise a plurality of circumferentially and/or longitudinally extending notches 236A as channels for injection of the gap-filling material.

Correspondingly, the uphole coupling section of the box (not shown) in these embodiments also only comprises a plurality of pockets 242B at corresponding locations, and do not comprise any longitudinally extending ridges and grooves. The uphole coupling section of the box may also comprise a plurality of circumferentially and/or longitudinally extending notches 236B as channels for injection of the gap-filling material.

Although in some of above embodiments, the box 204 or 404 comprises one or more chambers 180 for receiving the data measurement and transmission components 132, in some alternative embodiments, the pin 202 comprises one or more chambers 180 for receiving the data measurement and transmission components 132. In some alternative embodiments, both the pin 202 and the box 204/404 comprise one or more chambers 180 for receiving therein the data measurement and transmission components 132.

Those skilled in the art will appreciate that the gapped apparatus in above embodiments may have different strengths against axial and/or rotational forces. For example, the gapped apparatus shown in FIGS. 7 and 8 may have the strongest strength against axial and rotational forces. On the other hand, the gapped apparatus 600 having one or more pockets 242A and 242B but without any keys 612 for inserting into the grooves 494 may be weak against rotational forces. Those skilled in the art will also appreciate that different embodiments of the gapped apparatus may be used in different scenarios based on their strengths against axial and/or rotational forces.

Although in some of above embodiments, the pin is uphole to the box, in some alternative embodiments, the pin may be downhole to the box.

Although embodiments have been described above with reference to the accompanying drawings, those of skill in the art will appreciate that variations and modifications may be made without departing from the scope thereof as defined by the appended claims.

What is claimed is:

1. A bottom-hole assembly for use in a subterranean area under a surface, the bottom-hole assembly comprising:

a first sub directly or indirectly coupled to a drill bit, the first sub comprising at least one or more sensors for collecting sensor data and an Electro-Magnetic (EM) transmitter for transmitting the sensor data via EM signals;

a mud motor directly or indirectly coupled to the first sub; and a telemetry sub assembly directly or indirectly coupled to the mud motor;

wherein the first sub comprises:

a plurality of spring-loaded electrical-contact pads, each of the plurality of spring-loaded electrical-contact pads comprising a profile curved towards the radial center of a body of the first sub, and being radially outwardly biasable for contacting subsurface earth for transmitting the EM signals; and an electrically conductive sub body, and an electrically conductive sleeve electrically insulated from the electrically conductive sub body by an electrically insulating layer; wherein the electrically conductive sleeve comprises the plurality of spring-loaded electrical-contact pads; and wherein the electrically conductive sub body and the plurality of spring-loaded electrical-contact pads form an antenna;

wherein the telemetry sub assembly comprises at least:

an EM receiver for receiving the EM signals transmitted from the EM transmitter of the first sub; and a mud pulser for generating mud pulses based on the received EM signals for transmitting the sensor data to the surface.

2. The bottom-hole assembly of claim 1, wherein the first sub further comprises:

a controller coupled to the one or more sensors and the EM transmitter for collecting the sensor data from the one or more sensors, processing the collected sensor data into a format for EM transmission, and controlling the EM transmitter to transmit the processed data to the telemetry sub assembly via an EM signal; and one or more batteries for powering the one or more sensors, the EM transmitter, and the controller.

3. The bottom-hole assembly of claim 1, wherein the sensor data comprises azimuthal measurement and wellbore parameters.

4. The bottom-hole assembly of claim 3, wherein the wellbore parameters comprise borehole trajectory parameters and geological formation characteristics for diagnosis of a change in drilling direction.

5. The bottom-hole assembly of claim 3, wherein the sensor data further comprises one or more of formation parameters, drilling performance parameters, and parameters related to measurement of other parameters.

6. The bottom-hole assembly of claim 1, wherein the telemetry sub is configured for:

collecting measurement data using one or more sensors therein;

verifying the sensor data received from the first sub using the collected measurement data; and controlling the mud pulser for generating mud pulses based on the verified sensor data for transmitting the verified sensor data to the surface.

7. The bottom-hole assembly of claim 1, wherein the telemetry sub further comprises:

an EM transmitter for transmitting the sensor data to the surface.

8. The bottom-hole assembly of claim 1, wherein the first sub comprises:

a dipole antenna for transmitting the EM signals;

wherein the dipole antenna is formed by two electrically-conductive metal body sections separated by an electrically insulating layer.

9. The bottom-hole assembly of claim 8, wherein the telemetry sub comprises:

a gapped mechanical connection forming a dipole antenna for receiving the EM signals transmitted from the first sub.

10. The bottom-hole assembly of claim 1, wherein the first sub comprises three spring-loaded electrical-contact pads.

11. The bottom-hole assembly of claim 1, wherein the first sub comprises a pin coupled to a box downhole thereto; and wherein either the pin or the box comprises the plurality of spring-loaded electrical-contact pads.

* * * * *